US006137507A

United States Patent [19]

Inui et al.

[11] Patent Number: 6,137,507

[45] Date of Patent: Oct. 24, 2000

[54] INK JET PRINTING SYSTEM WHICH EJECTS BOTH INK AND AN INSOLUBILIZING OR COAGULATING LIQUID

[75] Inventors: Toshiharu Inui, Yokohama; Tetsuro Inoue, Tokyo; Noribumi Koitabashi, Yokohama; Masaya Uetsuki, Yokohama; Yoshinori Nakajima, Yokohama, all of Japan

[73] Assignee: Canon Kabushiki Kaisha, Tokyo, Japan

[21] Appl. No.: 08/904,273

[22] Filed: Jul. 31, 1997

[30] Foreign Application Priority Data

Aug. 2, 1996 [JP] Japan ..... 8-204618

[51] Int. Cl.[7] ..... B41J 2/01; B41J 2/21

[52] U.S. Cl. ..... 347/43; 347/101

[58] Field of Search ..... 347/41, 43, 101

[56] References Cited

U.S. PATENT DOCUMENTS

| | | | |
|---|---|---|---|
| 5,142,374 | 8/1992 | Tajika et al. | 358/298 |
| 5,477,246 | 12/1995 | Hirabayashi et al. | 347/43 X |
| 5,635,969 | 6/1997 | Allen | 347/96 |
| 5,640,187 | 6/1997 | Kashiwazaki et al. | 347/101 |
| 5,792,249 | 8/1998 | Shirota et al. | 106/31.27 |
| 5,805,190 | 9/1998 | Tsuchii et al. | 347/101 X |
| 5,898,443 | 4/1999 | Yoshino et al. | 347/101 X |
| 5,907,332 | 5/1999 | Fujita et al. | 347/43 X |
| 5,917,519 | 6/1999 | Arai et al. | 347/43 X |

FOREIGN PATENT DOCUMENTS

| | | |
|---|---|---|
| 0 516 420 | 12/1992 | European Pat. Off. . |
| 0 650 840 | 5/1995 | European Pat. Off. . |
| 0 703 087 | 3/1996 | European Pat. Off. . |
| 0 726 156 | 8/1996 | European Pat. Off. . |
| 0 726 158 | 8/1996 | European Pat. Off. . |
| 0 726 159 | 8/1996 | European Pat. Off. . |
| 56-84992 | 7/1981 | Japan . |
| 1-63185 | 3/1989 | Japan . |
| 3-146355 | 6/1991 | Japan . |
| 4-158049 | 6/1992 | Japan . |
| 7-195823 | 8/1995 | Japan . |

OTHER PUBLICATIONS

European Search Report.

*Primary Examiner*—William J. Royer
*Attorney, Agent, or Firm*—Fitzpatrick, Cella, Harper & Scinto

[57] ABSTRACT

A printing head having a nozzle group for ejecting an ink and a nozzle group for ejecting a printing ability improving liquid is used, and printing control is made so that the number of scannings of the printing head is increased as a print duty increases, thereby reducing generation of mist due to rebounding of the ink or the printing ability improving liquid from a printing medium side.

43 Claims, 21 Drawing Sheets

:DOTS OF k1 + s + k2

:DOTS OF k1 + k2

:BLACK IMAGE

:YELLOW IMAGE

:PRINTING ABILITY IMPROVING LIQUID DATA APPLIED TO BLACK IMAGE

:PRINTING ABILITY IMPROVING LIQUID DATA APPLIED TO YELLOW IMAGE

:BLACK IMAGE

:YELLOW IMAGE

:PRINTING ABILITY IMPROVING LIQUID DATA APPLIED TO BLACK IMAGE

:PRINTING ABILITY IMPROVING LIQUID DATA APPLIED TO YELLOW IMAGE

INK JET PRINTING SYSTEM WHICH EJECTS BOTH INK AND AN INSOLUBILIZING OR COAGULATING LIQUID

BACKGROUND OF THE INVENTION

1. Field of the Invention

The present invention relates to an ink jet printing method and an ink jet printing apparatus in which an ink is ejected to form an image on a printing medium. More specifically, this invention relates to an ink jet printing method and an ink jet printing apparatus in which a liquid is ejected to insolubilize or coagulate a coloring material in the ink.

2. Description of the Related Art

Heretofore, an ink jet printing apparatus for making printing onto a printing medium such as paper, cloth, plastic sheet, OHP sheet, and the like, since it is possible to make high-density and high-speed printing, has been utilized and commercialized as output means of an information processing system, for example, a printer as an output terminal of a copier, a facsimile, an electronic typewriter, a word processor, a workstation, and the like, or a handy or portable printer for a personal computer, a host computer, an optical disk apparatus, a video apparatus, and the like.

In this case, the ink jet printing apparatus has a construction for meeting the function and application mode specific to the apparatus. In general, an ink jet printing apparatus comprises a carriage including printing means (printing head) and an ink tank, a transportation means for transporting the printing paper, and a control means for controlling these components. During printing time, the printing head for ejecting ink droplets from a plurality of ejection openings is serially scanned in a direction (main-scanning direction) perpendicular to the transportation direction (sub-scanning direction) of the printing medium, whereas during non-printing time, the printing medium is intermittently transported in an amount equal to the printing width. This method is to make printing by ejecting an ink onto the printing medium according to a printing signal, and is widely used as a low running cost and quiet printing method. Further, by using the printing head having a plurality of nozzles for ejecting ink which are arranged on a straight line in the sub-scanning direction, the printing head is scanned on the printing medium to make printing having a width corresponding to the number of the nozzles. Then, a high-speed printing operation can be achieved.

Further, recently, the ink jet printing apparatus is practically used, which is equipped with 3 to 4 colors of the printing heads to enable formation of an image in full color. This apparatus can be equipped with three types of printing heads corresponding to the three primary colors of yellow (Y), magenta (M), and cyan (C) or four types of printing heads corresponding to these three primary colors and black (B).

However, because, in the conventional ink jet printing method and apparatus, prevention of ink bleeding occurring between individual colors of black (B), yellow (Y), magenta (M), and cyan (C), and increase in density of black image and prevention of feathering are contradictory problems, it is difficult to achieve the printing quality of color printing to a level sufficient for meeting the user needs. The reason will be described below.

In general, when a color image is formed on a plain paper by the ink jet printing method, a quick-drying ink which is fast in penetration speed into the plain paper is used.

Therefore, ink bleeding can be prevented in a boundary area between individual colors constituting the image. However, when the quick-drying ink is used, the black image portion tends to be low in density and the colored image portion other than black tends to be low in color formation density. Further, when a line image represented by letters is printed, the ink tends to bleed along fibers of the paper. This results in a so-called feathering. In particular, letters printed by a black ink tend to have remarkable feathering as compared with other colors, resulting in unclear letters of so-called less sharpness. As a result, the quality of the printed image is considerably deteriorated as a whole.

Generally, to obtain a high quality image which is high in density of the black image portion and free of feathering, it is necessary that an ink relatively low in penetration speed onto the plain paper is used and is ejected in a large amount to some extent. However, in this case, the black ink and color inks bleed in the adjacent boundary area of the black image portion with the color image portions, thereby considerably degrading the quality of the printed image.

To improve these defects, a method is practically used in which a heater is provided in the printing apparatus for promoting drying of the inks, thereby obtaining a color image of high color formation and without bleeding between colors. However, it is clear that this method cannot be avoidable in a size increase of the apparatus and a cost increase.

As described above, bleeding prevention of inks between black and individual colors, high-density of black image, and prevention of feathering are contrary problems to each other.

Then, Japanese Patent Application Laid-open No. 3-146355 proposes a method in which an area along the boundary area between black and colors is not printed. However, this method has a problem in that the printed data is changed.

Further, Japanese Patent Application Laid-open No. 4-158049 proposes a method which has heads of a plurality of colors for color printing and a head for letter printing, the plurality of color printing heads and the letter printing head being selected according to the image to be printed. In this method, when a black image printed by the color printing heads and a black image printed by the letter printing head are mixed, a sense of incompatibility occurs due to a difference in quality between both.

Still further, there is considered a method in which the black area along the boundary area between black and color is printed by ejecting the color inks in overlapping manner, thereby preventing bleeding in the boundary area between black and color. Although, in principle, black is obtained by overwriting (mixing) three colors of Y, M, and C, the black image formed by mixing color inks in this method is inferior in color formation as compared with ordinary black ink.

On the other hand, Japanese Patent Application Laid-open No. 56-84992 and Japanese Patent Application Laid-open No. 64-63185 disclose a technology using a liquid for insolubilizing a dyestuff in the ink.

Japanese Patent Application Laid-open No. 56-84992 discloses a method in which the printing paper is previously applied with a material for fixing the dyestuff. However, this method has problems to be solved in that it is required to use a specific printing paper, and for the application of the material for fixing the dyestuff, an increase in apparatus size and a cost increase are unavoidable, and it is difficult to apply the above material on the printing paper stably to a predetermined film thickness.

Yet further, Japanese Patent Application Laid-open No. 64-63185 discloses a technology for depositing a colorless ink for insolubilizing the dyestuff onto the printing paper by an ink jet printing head. With this method, since the dot diameter of the colorless ink is set greater than the dot diameter of the imaging ink, predetermined characteristics can be satisfied even when the application positions of an imaging ink and the colorless ink are deviated from each other. In this method, since the amount of the colorless ink applied to the portion corresponding to the image position is larger than usual, there is a problem to be solved in that not only the ink drying time is increased, but also a very unclear image is resulted.

Yet further, Japanese Patent Application Laid-open No. 7-195823 described that the printing paper surface is applied with the above colorless substance prior to ink jet printing, thereby particularly enabling color printing by one pass.

As described above, the methods disclosed in the prior art have problems to be solved.

By the way, as described above, when the ink and a printing ability improving liquid for insolubilizing or coagulating the coloring material in the ink are in contact with each other on the ejection opening face (or a face) to react on each other, an adhesion occurs on the ejection opening face, which results in deflecting of ink droplets leading to image degradation and results in ejection missing due to clogging of the ejection openings, thus greatly affecting the reliability.

One of the causes is rebounding of the ink or the printing ability improving liquid from the paper surface when they are ejected thereto.

The inventors have found that, with respect to generation of rebounding droplets from the paper surface, an amount of rebounding is also changed according to a print duty of the image. The droplets due to rebounding are small in amount when the print duty is low, whereas the droplets due to rebounding are large in amount when the print duty is high, thereby affecting the reliability of printing.

SUMMARY OF THE INVENTION

A primary object of the present invention is to provide an ink jet printing method and an ink jet printing apparatus which is able to reduce a mist due to rebounding of the ink or a treating liquid thereof to provide a high-density image, and is to provide an image free of bleeding between colors and with high color formation when applied to color printing.

In a first aspect of the present invention, there is provided an ink jet printing method using an ink ejection head having a nozzle for ejecting an ink and printing ability improving liquid ejection head having a nozzle for ejecting a printing ability improving liquid, and scanning the ejection head in a main scanning direction with respect to a printing medium to form an image, the method comprising the steps of:

ejecting the ink from the ink ejection head onto the printing medium; and ejecting the printing ability improving liquid from the printing ability improving liquid ejection head onto the printing medium;

wherein, when a process for ejecting the ink and a process for ejecting the printing ability improving liquid are carried out based on an image data to form the image on the printing medium while moving the ink ejection head and the printing ability improving liquid ejection head in the main scanning direction, a number of scannings of the ink ejection head and the printing ability improving liquid ejection head in the main scanning direction for making the process for ejecting the ink and the process for ejecting the printing ability improving liquid is differentiated according to a print duty of the image data.

In a second aspect of the present invention, there is provided an ink jet printing apparatus using an ink ejection head having a nozzle for ejecting an ink and a printing ability improving liquid ejection head having a nozzle for ejecting a printing ability improving liquid, scanning the ejection head in a main scanning direction with respect to a printing medium to form an image, the apparatus comprising:

first printing control means for controlling ejection of the ink from the ink ejection head onto the printing medium;

second printing control means for controlling ejection of the printing ability improving liquid from the printing ability improving liquid ejection head onto the printing medium; and scanning number control means whereby, when a control for ejecting the ink and a control for ejecting the printing ability improving liquid are carried out based on an image data to form the image on the printing medium while a control for moving the ink ejection head and the printing ability improving liquid ejection head in the main scanning direction, a number of scannings of the ink ejection head and the printing ability improving liquid ejection head in the main scanning direction for making the control for ejecting the ink and the control for ejecting the printing ability improving liquid is differentiated according to a print duty of the image data.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Preferred embodiments of the present invention will be described in detail with reference to the drawings.

First, a first embodiment of the present invention will be described.

Figure 1:
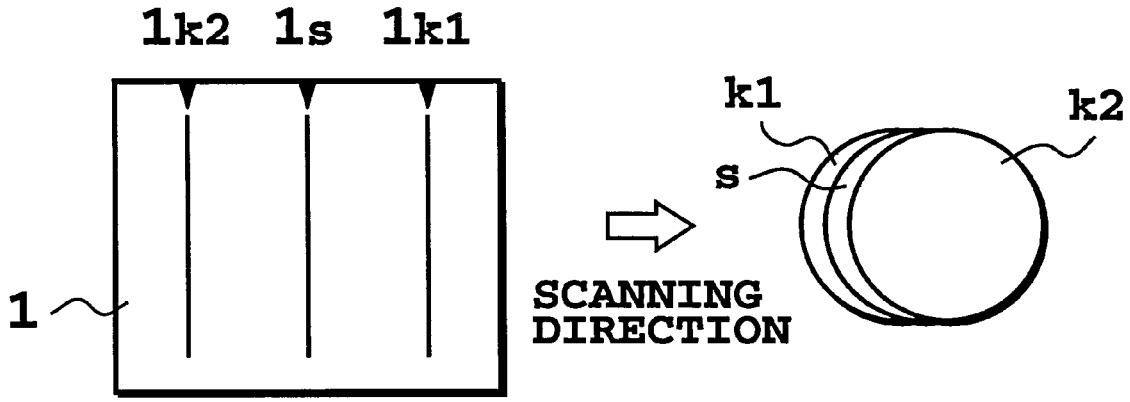
FIG. 1 is a schematic view showing a printing method using a printing head as a first embodiment according to the present invention.

FIG. 1 shows a schematic view for explaining the brief structure of the printing head 1, which include nozzle groups 1*k*1 and 1*k*2 for ejecting black ink and a nozzle group (hereinafter also referred as "head") 1*s* arranged between the nozzle groups 1*k*1 and 1*k*2 for ejecting a printing ability improving liquid.

Figure 2A:
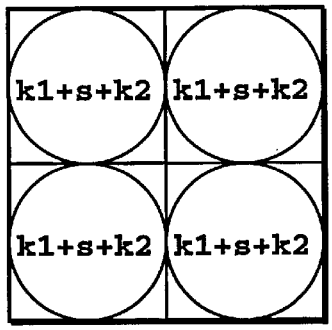
FIGS. 2A to 2D are schematic views for explaining application of a printing dot.
Figure 2B:
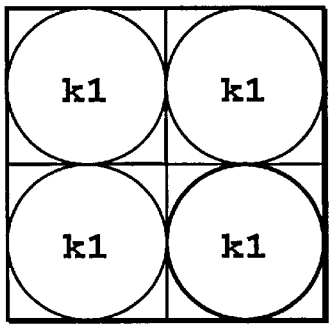
Figure 2C:
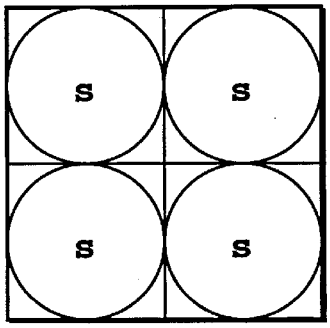
Figure 2D:
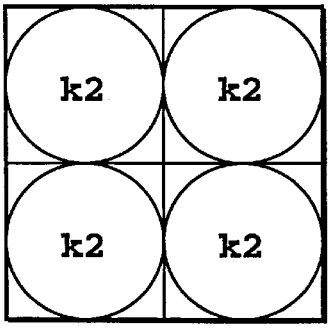

FIGS. 2A to 2D show an example of a process for controlling ejection of the black ink and the printing ability improving liquid to each pixel. FIG. 2A shows a result of ejection of the black ink by means of the head 1*k*1 and 1*k*2 and ejection of the printing ability improving liquid by means of the head 1*s*, to 2×2. To obtain the image of FIG. 2A, first, as shown in FIG. 2B, control is made so that the black ink k1 is ejected by means of the head 1*k*1. Then, as shown in FIG. 2C, control is made so that the printing ability improving liquid is ejected by means of the head is to the same pixel. Finally, as shown in FIG. 2D, control is made so that the black ink k2 is ejected by the printing head 1*k*2 to the same picture element shown in FIGS. 2B and 2C, thus completing the image formation process using the black ink and the printing ability improving liquid.

As described above, an adhesion occurs at the ejection opening face caused by the ink contacts with the printing ability improving liquid at the ejection opening face (or face) of each printing head to react with each other. Then, deflection of ink droplets by the adhesion causes image degradation and ejection missing due to clogging at the ejection openings, thus greatly affecting the reliability of printing.

One of the causes is rebounding of the ink or the printing ability improving liquid from the paper surface when they are ejected to the printing medium. Rebounding in the above image formation process using the black ink and the printing ability improving liquid will be described in detail with reference to the schematic views shown in FIG. 3A–3C.

Figure 3A:
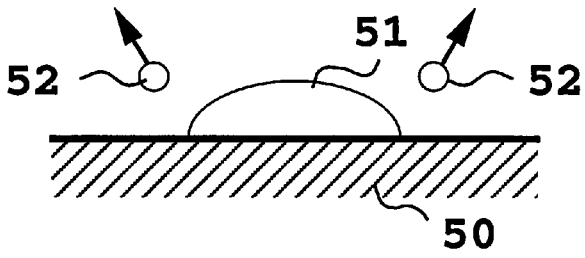
FIGS. 3A to 3C are schematic views for explaining rebounding of droplets generated when a liquid is applied.

FIG. 3A shows a state of rebounding generated when the ink or the printing ability improving liquid 51 is applied onto a printing medium 50. In this case, droplets 52 generated by rebounding fly in the reverse direction to the printing medium 50, that is, towards the ejection opening face of the printing head. In the present invention, since the first applied liquid is ink, the splashed droplets are black ink.

Figure 3B:
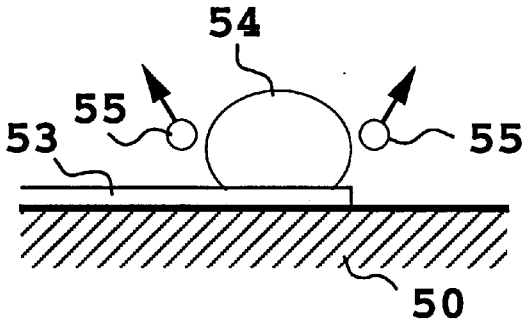

FIG. 3B shows a state of rebounding generated when the printing ability improving liquid 54 is applied after the ink is applied to the printing medium. In this case, the printing ability improving liquid 54 is applied to an ink layer 53 first applied, also at this moment, droplets 55 by rebounding fly in the reverse direction to the printing medium 50, that is, towards the ejection opening face of the printing head as in FIG. 3A.

Figure 3C:
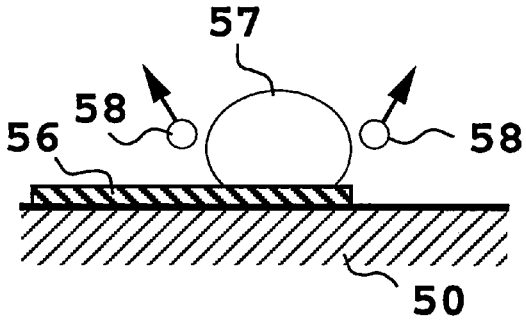

FIG. 3C shows a state of rebounding generated when the ink is further applied after the printing ability improving liquid is applied following ink application. Also in this case, the ink 57 is applied to the liquid layer 56 as a mixture of the first applied ink and the printing ability improving liquid, droplets 58 due to rebounding fly in the reverse direction to the printing medium 50 as in FIG. 3B, that is, towards the ejection opening face of the printing head.

As described above, the droplets 52 due to rebounding in FIG. 3A are those of the ink, however, the droplets 55 and 58 due to rebounding in FIGS. 3B and 3C are not always those of liquid of a single type. It has been clarified by the inventors in their studies that the component at this time depends on the surface tension and viscosity characteristics of the ink and printing ability improving liquid, and which is first applied.

For example, when the ink of high surface tension and the printing ability improving liquid of low surface tension are used, in the case of FIG. 3B, the droplets 55 are mainly those of the printing ability improving liquid, as a result, the printing ability improving liquid only adheres to the ejection opening face of the printing head (for printing ability improving liquid 1*s*), and an adhesion problem at the ejection opening face is less generated.

On the other hand, in the case of FIG. 3C, the droplets 58 contain reaction products of the printing ability improving liquid and the ink. As a result, the ejection opening face of the printing head (for ink 1*k*2) is adhered with a mixture of the ink and the printing ability improving liquid, which causes adhesion and clogging at the ejection opening face.

As described above, generation of droplets due to rebounding depends on the characteristics of the ink and the printing ability improving liquid and application order thereof, however, the amounts of the generation of droplets are changed according to the duty of the image to be printed. That is, when the duty is low, droplets due to rebounding are small in amount (very little), however, when the duty is high, droplets due to rebounding are generated in large amounts, thereby affecting the reliability.

In more detail, when the duty is low, a space between respective deposition position of the ink or the printing ability improving liquid on the printing medium is wide. Thereby a space for penetration of the ink per one deposition position becomes large. As a result, the penetration of the previously applied ink or the printing ability improving liquid is promoted to decrease rebounding droplets. On the other hand, when the duty is high, the space between the deposition positions on the printing medium is small. Thereby the penetration space of the ink into the printing medium is small. Therefore, the penetration speed of the previously applied ink or the printing ability improving liquid is small to increase rebounding droplets.

With a view to eliminate the above problems, in the present application, the image formation process (the number of scannings) is controlled according to the image duty.

For example, when the image duty is low, the processes of FIGS. 2B to 2D are completed by a single scanning of the printing head. On the other hand, when the image duty is high, that is, when generation of droplets due to rebounding is considerable at the printing head 1*k*2, in the printing process shown in FIG. 2A, the processes of FIG. 2B and FIG. 2C are carried out by the first scanning of the printing head, and the process of FIG. 2D is carried out by the second scanning. With this method, when the ink is ejected from the printing head 1*k*2 in the process of FIG. 2D and deposits onto the printing paper, the previously applied ink and the printing ability improving liquid dry to some extent or penetrate into the printing paper. Then, rebounding of a mixture of the ink and the printing ability improving liquid is suppressed.

Figure 4A:
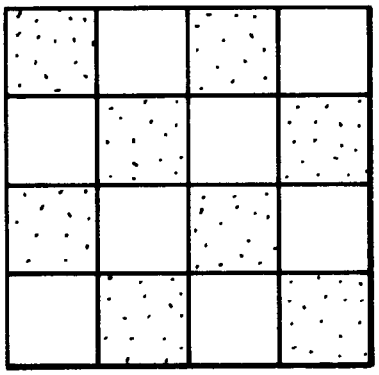
FIGS. 4A and 4B are schematic views for explaining a method for dividedly printing an image.
Figure 4B:
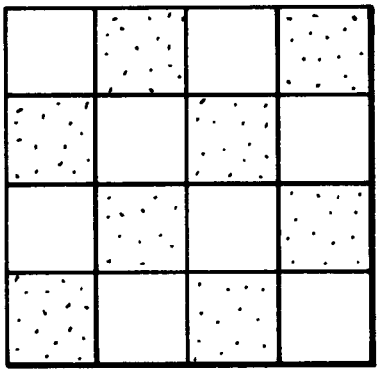

Further, as another suppression method, when the image duty is low, the processes of FIGS. 2B to 2D are completed by a single scanning of the printing head, on the other hand, when the image duty is high, the image is formed by two scannings. FIGS. 4A and 4B show an example of this process, in which printing is carried out according to the pattern (overall black picture elements in the Figure) of FIG. 4A by the first scanning of the printing head, then printing is carried out according to the pattern of FIG. 4B by the second scanning. Therefore, generation of droplets due to rebounding is suppressed since the duty printed by one scanning of the printing head is decreased.

More preferably, with respect to each thinned image data of FIG. 4A or 4B, the printing may be carried out so that the number of scannings in each ejection shown in FIGS. 2B to 2D is varied. For example, in the thinned image data shown in FIG. 4A, when reduction in generation of mist due to rebounding is insufficient, in printing based on the thinned image data shown in FIG. 4A, the ink of FIG. 2B and the printing ability improving liquid of FIG. 2C are ejected at the first scanning, and the ink of FIG. 2D is ejected at the second scanning. Thus, also in the printing based on the thinned image data, after the previously applied ink and the printing ability improving liquid dry to some extent or penetrate into the printing medium, the ink is further ejected. Thereby rebounding of mixture of the ink and the printing ability improving liquid can be remarkably suppressed.

Yet further, when generation of droplets due to rebounding is considerable at the printing head is, the process of FIG. 2B may be carried out by the first scanning of the printing head, and the processes of FIGS. 2C and 2D may be carried out by the second scanning.

Next, another embodiment of the present invention will be described.

Figure 18:
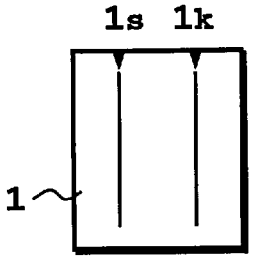
FIG. 18 is a schematic view showing the printing method using a printing head as a third embodiment according to the present invention.

FIG. 18 shows a schematic view for explaining the brief structure of the printing head 1, which is provided with a nozzle group 1*k* for ejecting the black ink and a nozzle group 1*s* for ejecting the printing ability improving liquid.

Figure 19A:
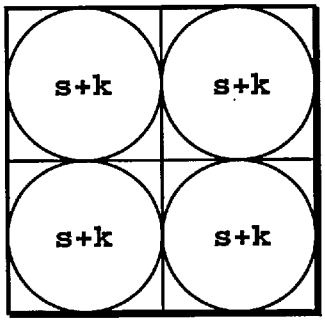
FIGS. 19A to 19C are schematic views for explaining application of a printing dot.
Figure 19B:
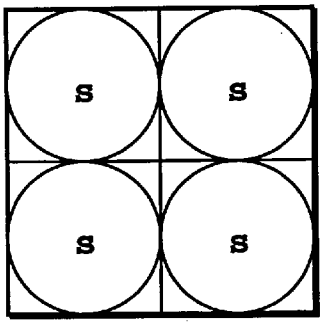
Figure 19C:
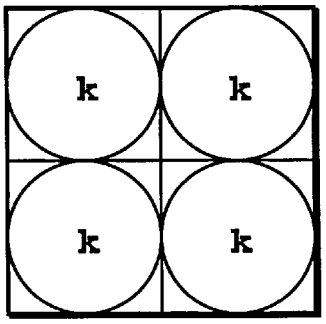

FIG. 19A to 19C show examples of a process for controlling the black ink and the printing ability improving liquid to the individual printing picture elements, in which FIG. 19A shows the result of ejecting the black ink by the printing head 1*k* of, for example, 2×2 picture elements and ejecting the printing ability improving liquid by the printing head 1*s*. To obtain the image of FIG. 19A, first, control is made as shown in FIG. 19B, so that the printing ability improving liquid s is ejected by the printing head is to the same picture elements. Then, as shown in FIG. 19C, control is made so that the black ink k is ejected by the printing head 1*k* to the same picture elements shown in FIG. 19B. This printing control completes the image formation process using the black ink and the printing ability improving liquid.

Figure 20A:
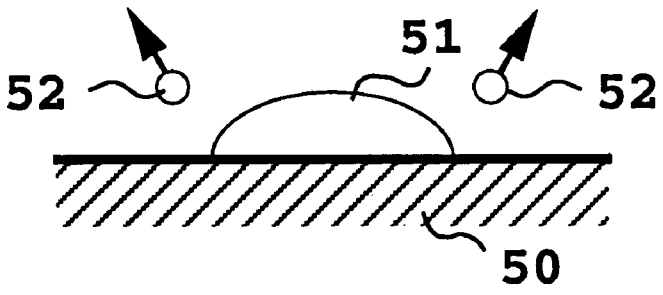
FIGS. 20A and 20B are schematic views for explaining droplet rebounding generated when a liquid is applied.

Similarly to the above described example, FIG. 20A shows a state of rebounding generated when the ink or the printing ability improving liquid 51 is applied to a printing medium 50. In this case, droplets 52 generated by rebounding fly in the reverse direction to the printing medium 50, that is, towards the ejection opening face of the printing head. In this example, since the first applied liquid is the printing ability improving liquid, the rebounding droplets are those of the printing ability improving liquid.

Figure 20B:
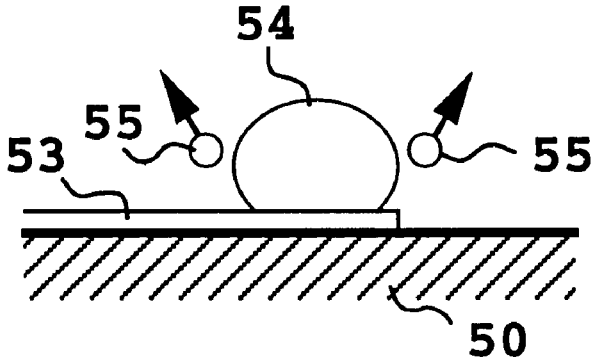

FIG. 20B shows state of rebounding generated when the ink 54 is applied after the printing ability improving liquid 51 is applied on the printing medium 50. In this case, the ink 54 is applied to the layer 53 of the first applied printing ability improving liquid 51, also in this case, as in FIG. 20A, droplets 55 due to rebounding fly in the reverse direction to the printing medium 50, that is, towards the ejection opening face of the printing head.

In this case, as described above, when the ink of high surface tension and the printing ability improving liquid of low surface tension are used, in the case of FIG. 20B, the droplets 55 are mainly those of the ink since the layer thickness of the printing ability improving liquid 53 is very small. As a result, the ink only adheres to the ejection opening face of the printing head (for black ink 1*k*), and the adhesion problem at the ejection opening face tends to occur less.

However, when the printing ability improving liquid is low in surface tension, it is not preferable to extremely decrease the surface tension in view of the image since the sharpness of the image is impaired. Since the printing ability improving liquid 53 becomes difficult to soak as the surface tension increases, the droplets 55 contain reaction products of the printing ability improving liquid and the ink in the case of FIG. 20B. As a result, the ejection opening face of the printing head (for ink 1*k*) is adhered with a mixture of the ink and the printing ability improving liquid, which may result in adhesion or clogging at the ejection opening face. Further, when the printing head of the structure as shown in FIG. 18 is used, and the printing ability improving liquid and the ink are ejected in this order, rebounding mist of the later applied ink is mixed up with the printing ability improving liquid, thus causing the same problem.

Therefore, even when the printing head shown in FIG. 18 is used, the amounts of generation of droplets are changed according to the duty of the image. That is, the droplets due to rebounding are small in amount (very little) when the duty is low, however, large amounts of droplets due to rebounding are generated when the duty is high, thereby affecting the reliability of printing.

For example, when the image duty is low, the processes of FIGS. 19B to 19C are completed by a single scanning of the printing head. On the other hand, when the image duty is high, in the printing process shown in FIG. 19A to 19C, the process of FIG. 19B is carried out by the first scanning of the printing head, and the process of FIG. 19C is carried out by the second scanning. This method suppresses rebounding of a mixture of the ink and the printing ability improving liquid. In the process of FIG. 19C, when the ink is ejected from the printing head 1*k* to be deposited on the printing paper, the previously applied printing ability improving liquid dries to some extent or penetrates into the printing paper. Then, rebounding of a mixture of the ink and the printing ability improving liquid is suppressed.

Further, when the image duty is low, the processes of FIGS. 19B to 19C are completed by a single scanning of the printing head, on the other hand, when the image duty is high, the image is formed by two scannings. FIGS. 4A and 4B show examples of this method, in which printing is carried out according to the pattern (overall black picture elements in the Figure) of FIG. 4A at the first scanning of the printing head, then printing is carried out according to the pattern of FIG. 4B at the second scanning of the printing head. Therefore, generation of droplets due to rebounding is suppressed since the duty printed by one scanning of the printing head is decreased.

More preferably, with respect to each thinned image data of FIG. 4A or 4B, the printing may be carried out so that the number of scannings in each ejection shown in FIGS. 19B and 19C is varied. For example, in the thinned image data shown in FIG. 4A, when reduction in generation of mist due to rebounding is insufficient, in printing based on the thinned image data shown in FIG. 4A, the printing ability improving liquid of FIG. 19B is ejected at the first scanning, and the ink of FIG. 19C is ejected at the second scanning. Thus, also in the printing based on the thinned image data, after the previously applied ink and the printing ability improving liquid dry to some extent or penetrate into the printing medium, the ink is further ejected. Thereby rebounding of a mixture of the ink and the printing ability improving liquid can be remarkably suppressed.

Printing ability improvement means improvement of picture quality such as density, color saturation, sharpness of edges, dot diameter, and the like, and improvement of ink fixing, weather resistance such as water resistance, light resistance, and the like, that is, improvement of image preservability.

Insolubilization means a phenomenon that an anionic group contained in the dyestuff of the ink and a cationic group of a cationic substance contained in the printing ability improving liquid interact to produce an ionic bond, and a coloring material (dyestuff) homogeneously dissolved in the ink separates from the liquid. In this present invention, effects of improvement of letter quality and fixing can be obtained even though all of the dyestuff in the ink is not insolubilized.

Agglomeration is used in the same meaning as insolubilization when the coloring material used in the ink is a water soluble dyestuff having an anionic group. When the coloring material used in the ink is a pigment, a pigment dispersant or the pigment surface and the cationic group of the cationic substance contained in the printing ability improving liquid undergo an ionic interaction, further dispersion destruction of pigment occurs to increase the particle diameter of the pigment. Normally, viscosity of the ink increases in association with the above agglomeration. In this present invention, the effects such as improvement of density, improvement of letter quality, improvement of fixing, and the like can be obtained even though all of the dyestuff or the dispersant in the ink is not necessarily insolubilized.

Since the construction of the printing head is symmetrical between the right and left portions, a high quality image can be obtained in both scannings in right (main-scanning) and left directions.

Further, the number of printing scannings for image formation is increased when the duty of image data is high, the reliability can be improved.

Yet further, the present invention can be applied to all of the apparatus using a printing medium such as paper, cloth, non-woven fabrics, OHP sheet, and the like, specifically to office machines such as printers, copiers, facsimiles, and mass-production devices.

The present invention will be described further in detail with reference to practical examples.

EXAMPLE 1

First, a first example will be described with reference to FIGS. 5, 6, 7, and 8A to 8C.

Figure 5:
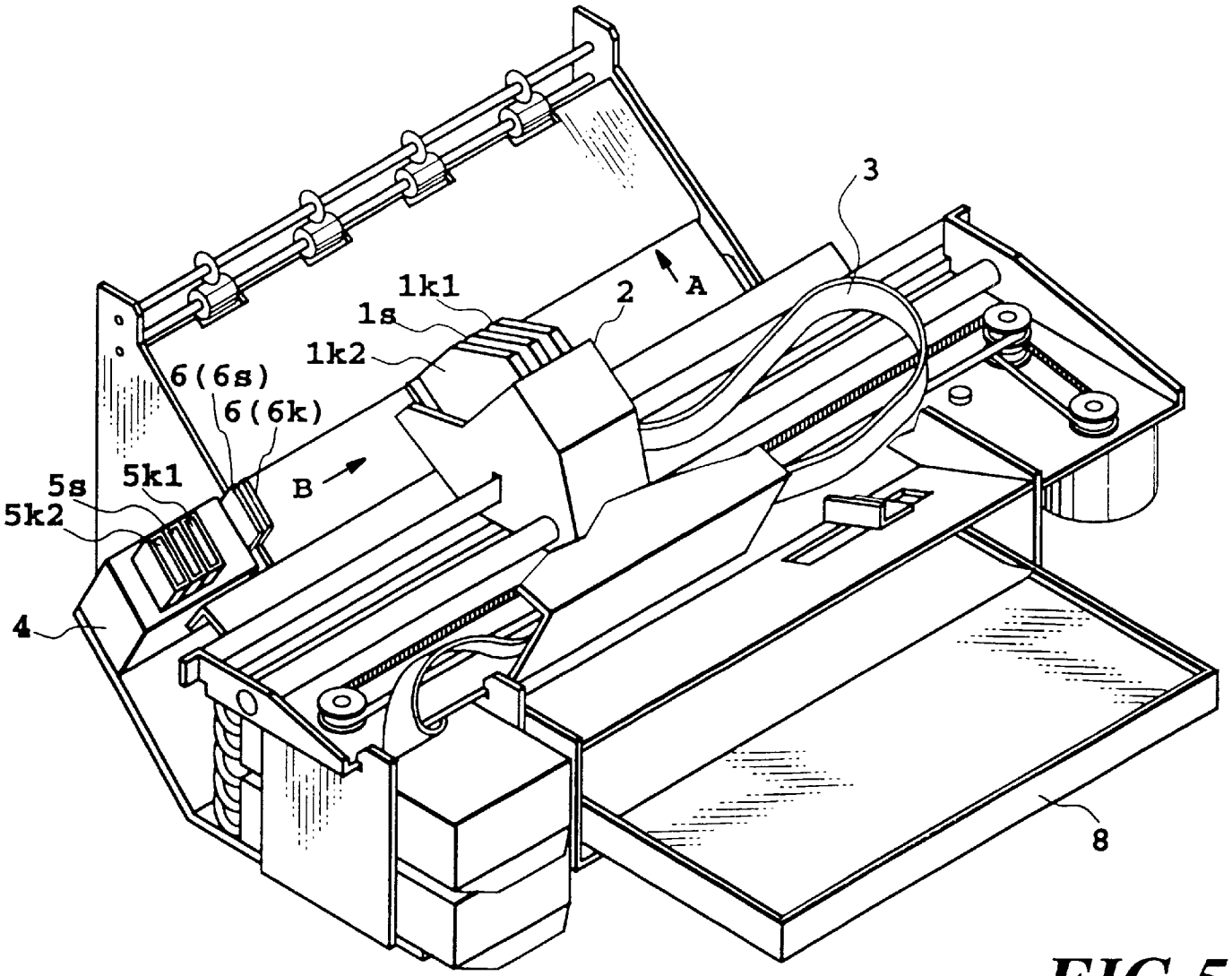
FIG. 5 is a schematic view showing the printer used in the embodiment 1.

FIG. 5 is for explaining the brief construction of an example (ink jet printer) of an ink jet printing apparatus which is possible to apply the present invention.

This printer comprises a carriage 2 equipped with a printing head is for ejecting the printing ability improving liquid and printing heads 1*k*1 and 1*k*2 for ejecting the black ink, a flexible cable 3 for sending an electrical signal from the printer main unit to the printing heads, a cap unit 4 having recovery means, and a paper feed tray 8 for feeding a material to be printed. Further, the printing head 1*s* is disposed between the printing heads 1*k*1 and 1*k*2. Still further, the cap unit 4 comprises cap members 5*s*, 5*k*1, and 5*k*2 corresponding to the printing heads 1*s*, 1*k*1, and 1*k*2, a wiper blade 6 (6*s*) made of a material such as rubber and corresponding to the printing head is, and a wiper blade 6 (6*k*) corresponding to the printing heads 1*k*1 and 1*k*2. In the printer of this construction, the printing heads 1*s*, 1*k*1, and 1*k*2 are serial scanned in a direction (main-scanning direction) B perpendicular to the feeding direction A of the printing medium to make printing of a width corresponding to the number of nozzles. On the other hand, during non-printing time, the printing medium is intermittently fed in a feed amount equal to the printing width.

The printing heads 1*s*, 1*k*1, and 1*k*2 individually have 64 nozzles at a density of 360 units per inch, and about 40 ng of the printing ability improving liquid or ink is ejected from each nozzle. Therefore, the printing density in the sub-scanning direction is 360 dpi (dot per inch), and in association with this, the printing density in the main-scanning direction is also 360 dpi.

Figure 6:
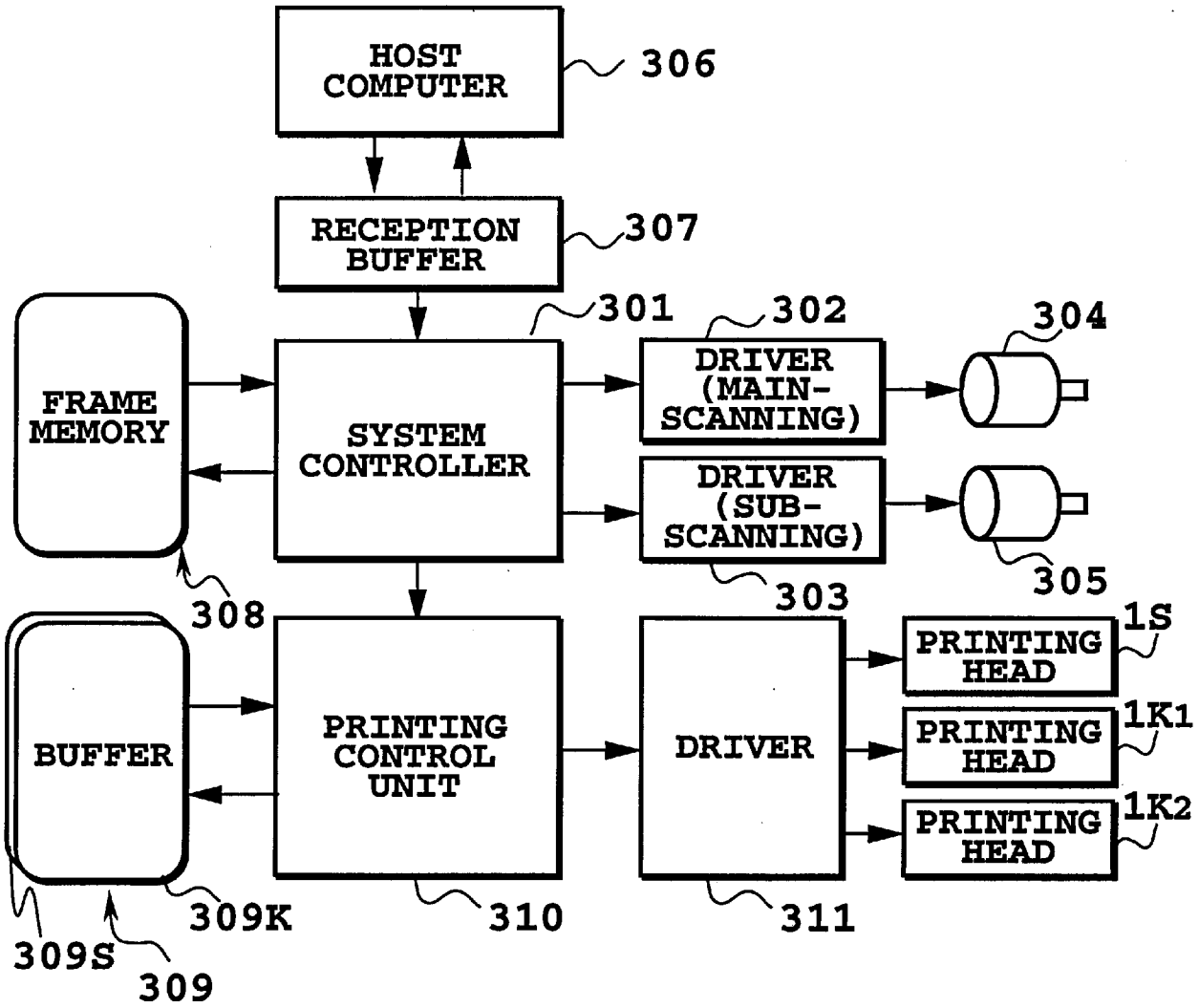
FIG. 6 is an electrical control block diagram of the printer used in embodiment 1.

FIG. 6 is an electrical control block diagram of the above described ink jet printer.

A reference numeral 301 denotes a system controller for controlling the entire apparatus. The controller 301 incorporates a microprocessor, a memory device (ROM) for storing control programs, a memory device (RAM) used when the microprocessor makes processing, and the like. A reference numeral 302 denotes a driver for driving the printing head in the main-scanning direction and, similarly, a reference numeral 303 denotes a driver for moving the printing medium in the sub-scanning direction. A reference numeral 304 and 305 denote motors corresponding to the drivers, which receive information such as speed, moving distance, and the like from the drivers to operate.

A reference numeral 306 denotes a host computer, which transfers information to be printed to the printing apparatus of the present invention. A reference numeral 307 denotes a reception buffer for temporarily storing data from the host computer 306, and stores the data until the data is read from the system controller 301. A reference numeral 308 denotes a frame memory for developing the data to be printed into image data. In the present example, a frame memory which can store one sheet of printing paper is described, however, the present invention is not limited by the size of the frame memory. A reference numeral 309 denotes a buffer (memory device) for temporarily storing the data to be printed, the storage capacity thereof varies with the number of nozzles of the printing heads. A reference numeral 310 denotes for appropriately controlling the printing heads by the instruction from the system controller 301, which is a print control unit for controlling the printing speed, printing data, and the like, and also makes preparation of data for ejecting the printing ability improving liquid. Further, counting of print duty of image data to be printed by one scanning of the printing head is also made by the print control unit 310. A reference numeral 311 denotes a driver for driving the printing head 1*s* for ejecting the printing ability improving liquid and the printing heads 1*k*1 and 1*k*2 for ejecting the black ink, this driver is controlled by signals from the print control unit 310.

First, image data is transferred from the host computer 306 to the reception buffer 307 and temporarily stored therein. The stored image data is read by the system controller 301 and developed in the buffer 309. The print control unit 310 makes preparation of data for ejecting the printing ability improving liquid according to the data developed in the buffer 309. Movement of the printing head is controlled according to the image data and the printing ability improving liquid data in the individual buffers.

Figure 7:
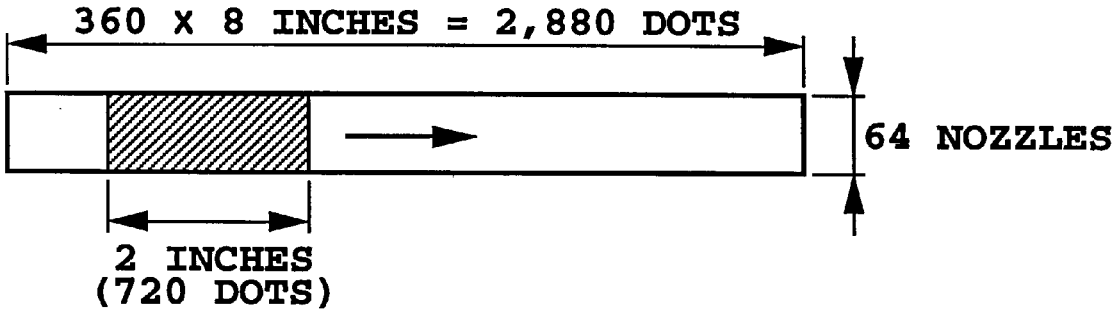
FIG. 7 is a schematic view for explaining a print duty counting method.

In the printer of the present example, the number of scannings for forming the image is varied according to whether the print duty in one scanning of the printed image is high or low. Specifically, as shown in FIG. 7, in the image area printed by one scanning, a window of 64 nozzles×2 inches (720 columns)=46,080 picture elements is scanned column by column from left to right in the Figure. As a result, the number of scannings for forming the image is varied between when the print duty is less than 50% in each window, and when the print duty of any one window exceeds 50%. The image data of one scanning shown in FIG. 7 is stored in the buffer shown in FIG. 6, and the above print duty determination processing is carried out by the print control unit 310.

Figure 8A:
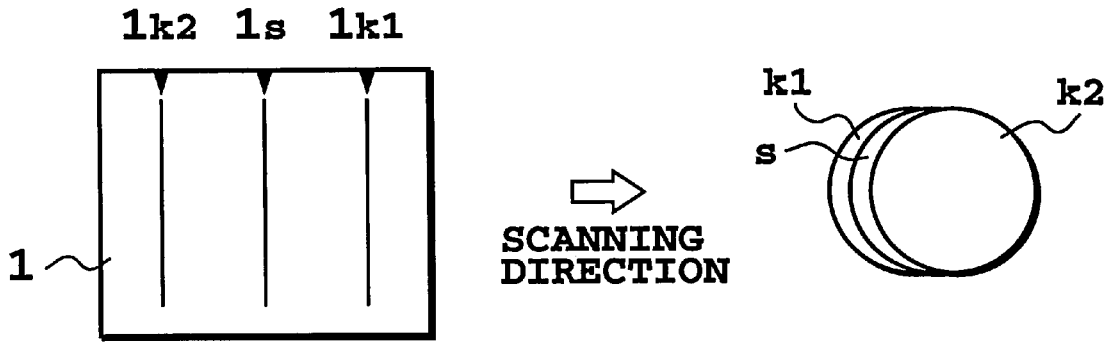
FIGS. 8A to 8C are schematic views for explaining the printing method in embodiment 1.

Here, the printing method will be described with reference to FIGS. 8A to 8C. When the print duty is less than 50%, as shown in FIG. 8A, printing dots k1, s, and k2 are sequentially applied by the printing heads 1*k*1, 1*s*, and 1*k*2 by one scanning of the printing head. Since the image data within the scanning area is all printed in the scanning at this time, the printing head returns again to the home position after completion of printing, and the printing paper is fed by an amount of 64 nozzles.

Figure 8B:
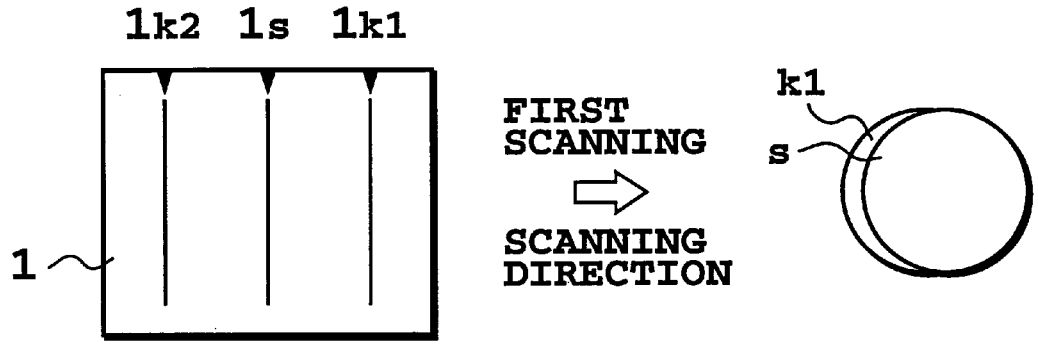
Figure 8C:
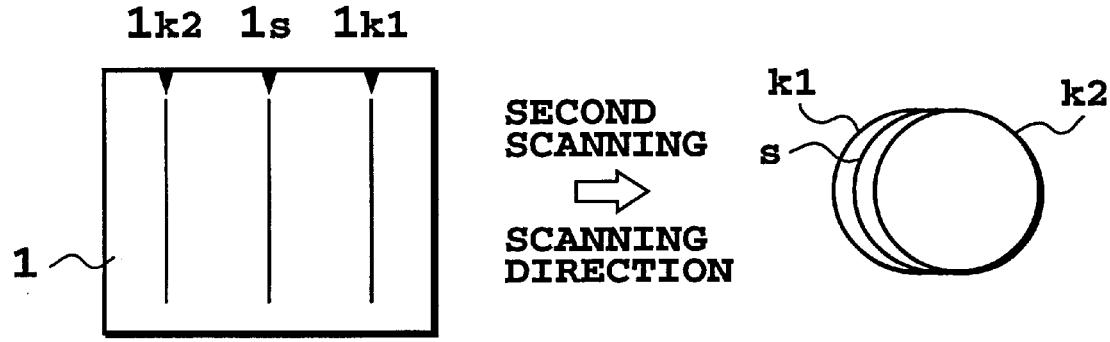

On the other hand, when the print duty exceeds 50%, as shown in FIG. 8B, printing dots k1 and s are sequentially applied by the printing heads 1*k*1 and is by the first scanning of the printing head. Then, the printing head returns again to the home position side, but at this time, the printing paper is not fed. Further, in the second scanning, as shown in FIG. 8C, the printing dot k2 is applied by the printing head k2 over the printing dots k1 and s first applied by the printing heads 1*k*1 and Is. Next, the printing head returns to the home position and the printing paper is fed by an amount of 64 nozzles.

The present example uses the ink and printing ability improving liquid as shown below:

| | | |
|---|---|---|
| (Ink) | | |
| Glycerin | 5 | parts by weight |
| Thiodiglycol | 5 | |
| Urea | 5 | |
| Isopropyl alcohol | 4 | |
| C. I. Direct Black 154 | 3 | |
| Water | 78 | |
| (Printing ability improving liquid) | | |
| Polyacrylamine-hydrochloride | 1 | part by weight |
| Tributylamine chloride | 1 | |
| Thiodiglycol | 10 | |
| Acetinol | 0.5 | |
| Water | 87.5 | |

It has been confirmed that the black image obtained in the present example is high-density, a sharp image of reduced feathering, and has a sufficient water resistance.

Further, adherence of mist due to rebounding at the ejection opening face of the printing head is very small irrespective of the kind of image, and degradation of reliability due to adhesion of a mixture of the ink and printing ability improving liquid in the vicinity of the ejection opening face could be prevented.

In the present example, the threshold value of print duty for changing the number of scannings is set to 50%, however, the present invention is not limited to the example.

EXAMPLE 2

Next, a second example will be described with reference to FIGS. 9A to 9C.

In this example, in the ink jet printing apparatus used in Example 1, the printing method when the print duty exceeds 50% is differed from Example 1. Since the printing method when the print duty is less than 50% is the same as Example 1, detailed description thereof is omitted.

Figure 9A:
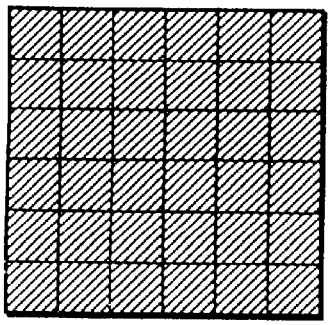
FIGS. 9A to 9C are schematic views for explaining application of the ink and a printing ability improving liquid in an embodiment 2.
Figure 9B:
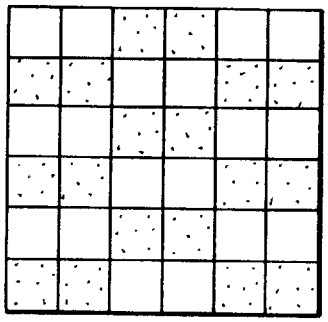
Figure 9C:
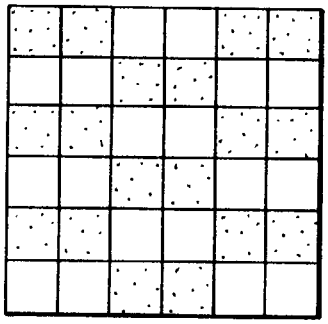

FIGS. 9A to 9C show the printing method at this time, to the image data of FIG. 9A, FIG. 9B shows the image (overall black picture elements) printed by the first scanning of the printing head, and FIG. 9C shows the image printed by the next scanning of the printing head. That is, when the print duty exceeds 50%, the image is formed by two scannings.

First, in the first scanning of the printing head, to the image of FIG. 9A, only the image of the pattern shown in FIG. 9B is printed. At this time, to the corresponding picture elements, printing dots k1, s, and k2 are sequentially applied by the printing heads 1*k*1, 1*s*, and 1*k*2. Then, the printing head returns to the home position side, but the printing paper is not fed. Further, printing of only the picture element of the pattern shown in FIG. 9C is made by the second scanning of the printing head. Also at this time, to the corresponding picture elements, the printing dots k1, s, and k2 are sequentially applied by the printing heads 1*k*1, 1*s*, and 1*k*2. Finally, the printing head returns to the home position side and the printing paper is fed in an amount of 64 nozzles.

When a black image was printed by the above printing method using the same ink and printing ability improving liquid same as Example 1, the same effect as Example 1 could be obtained.

EXAMPLE 3

Next, a third example will be described with reference to FIGS. 10A to 10D.

Although the threshold value of print duty is set to 50% in the above Example 1, it is further divided in the present example.

When the print duty is less than 33%, the printing dots k1, s, and k2 are sequentially applied by one scanning as in Example 1.

When the print duty exceeds 33% and is less than 66%, similarly to the printing method in Example 1 when exceeding 50%, printing dots k1 and s are applied by the first scanning, and the printing dot k2 is applied by the second scanning. Also in this case, feeding of the printing paper is made after the second scanning is completed.

Figure 10A:
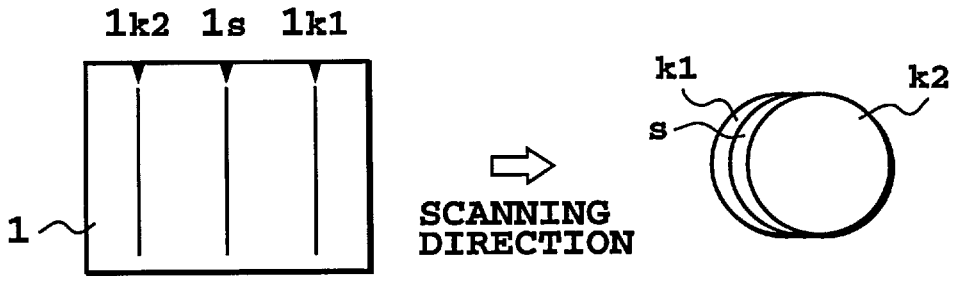
FIGS. 10A to 10D are schematic views for explaining a printing method in an embodiment 3.
Figure 10B:
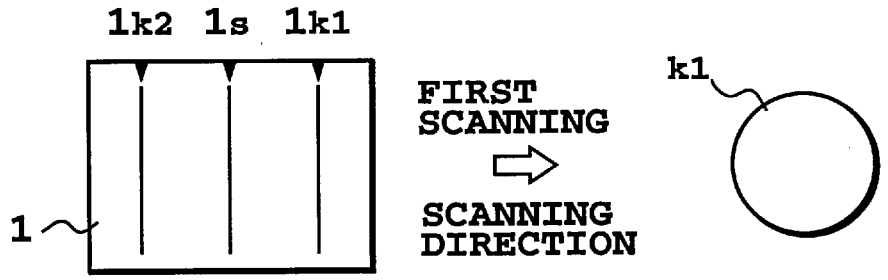
Figure 10C:
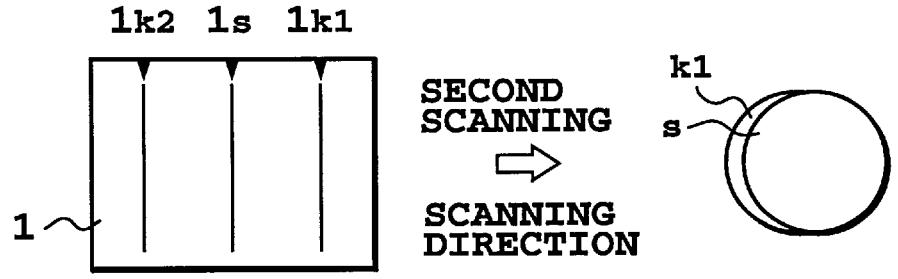
Figure 10D:
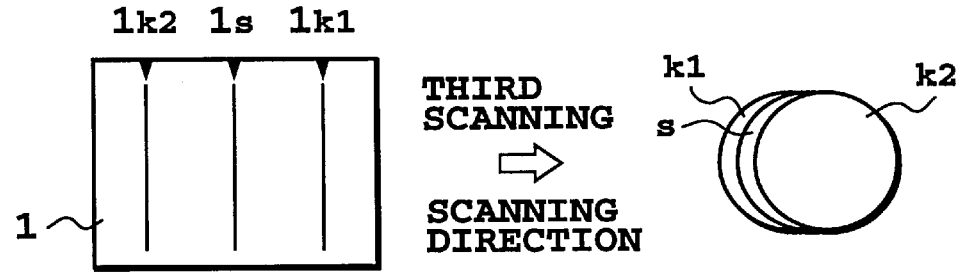

When the print duty exceeds 66%, as shown in FIG. 10B, the printing dot k1 is applied by the first scanning, followed by application of the printing dot s by the next second scanning as shown in FIG. 10C, and then as shown in FIG. 10D, the printing dot k2 is applied by the third scanning. This forms the printing dots as shown in FIG. 10A. Feeding of the printing paper is made after completion of the third scanning.

With this method, since printing dots k1, s, and k2 are individually applied by separate scannings, drying and penetration into the printing paper of the prior applied printing dot are advanced. Therefore, generation of mist due to rebounding is further suppressed, thereby improving the reliability.

EXAMPLE 4

Next, a fourth example will be described with reference to FIGS. 11A to 11E.

In the present example, the threshold value of print duty and the number of divisions in Example 2 are differed as in Example 3.

That is, when the print duty is less than 33%, the printing dots k1, s, and k2 are sequentially applied by one scanning as in Example 2.

When the print duty exceeds 33% and is less than 66%, similarly to the printing method in Example 2 when exceeding 50%, the printing image is divided into two parts, and the printing dots are applied by two scannings of the printing head.

Figure 11A:
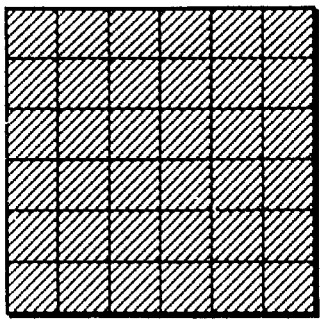
FIGS. 11A to 11E are schematic views for explaining application of the ink and the printing ability improving liquid in an embodiment 4.
Figure 11B:
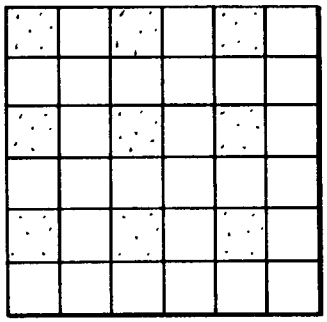
Figure 11C:
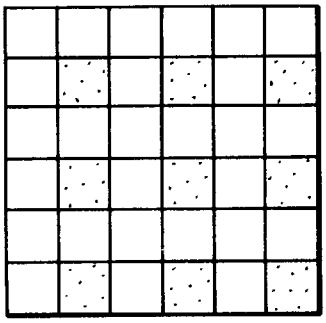
Figure 11D:
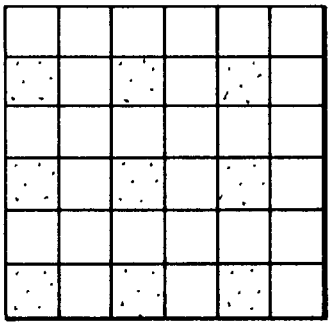
Figure 11E:
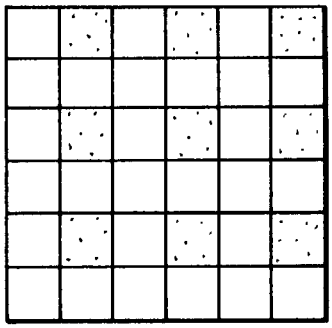

When the print duty exceeds 66%, as shown in FIGS. 11A to 11E, the image of FIG. 11A is divided into four parts of FIGS. 11B, 11C, 11D, and 11E to apply the printing dots. Therefore, in this case, the number of scannings of the printing head is four, and to the predetermined image, the printing dots k1, s, and k2 are sequentially applied. Further, feeding of the printing paper is made after completion of the four scannings.

With the present example, since the number of dots printed by one scanning is reduced, generation of mist due to rebounding is suppressed, thereby even further improving the reliability.

EXAMPLE 5

Next, a fifth example will be described with reference to FIGS. 12A to 12C.

Although Examples 1 to 4 use the same data for black image data as the data for ejecting the printing ability improving liquid, a modified data may be used in which the black image data is thinned out.

Figures 12A, 12B, 12C:
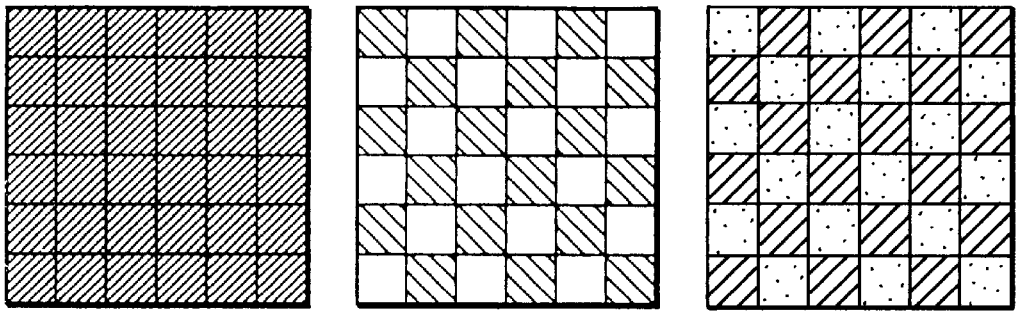
FIGS. 12A to 12C are schematic views for explaining application of the ink and the printing ability improving liquid in an embodiment 5.

For example, to the black image data as shown in FIG. 12A, in Examples 1 to 4, the data for ejecting the printing ability improving liquid was the same as the black image data, that is, the printing ability improving liquid was ejected by the same pattern as FIG. 12A, however, the printing ability improving liquid may be ejected by the pattern in which the black image data is thinned out as shown in FIG. 12B. In the example of FIG. 12B, the printing ability improving liquid is ejected to only the hatched picture elements. Therefore, as shown in FIG. 12C, overall black picture elements become dots applied sequentially with k1, s, and k2, and the hatched picture elements become dots applied only with k1 and k2.

In the present example, since the application amount of the printing ability improving liquid is smaller than in Examples 1 to 4, generation of mist due to rebounding is reduced accordingly, thereby the threshold value of print duty can be enhanced.

For example, in Example 1, application of the printing dot k2 by the printing head 1*k*2 is made by a difference scanning when the print duty exceeds 50%. However, in the present example, when the print duty is less than 75%, the printing dots k1, s, and k2 may be applied by one scanning of the printing head, and when the print duty exceeds 75%, only the printing dot k2 may be applied by a different scanning. This is also the same in Example 2.

Further, also for Examples 3 and 4, the printing method was differed when the print duty is less than 33%, exceeding 33% and less than 66%, and exceeding 66%. However, the threshold value of print duty can be changed, for example, when less than 50%, exceeding 50% and less than 75%, and exceeding 75%.

The thinning ratio of the printing ability improving liquid is appropriately set according to the required image quality, image characteristics such as water resistance, and combination of the ink used with the printing ability improving liquid.

For example, when the content of the polyacrylamine-hydrochloride contained in the printing ability improving liquid is increased to increase the reactivity with the ink, the thinning ratio can be increased to reduce the adherence amount of the printability improving liquid. Further, it is also possible to increase the thinning ratio by using a dyestuff having water resistance to some extent as a coloring material for the ink.

Further, the thinning method in this case is not limited to the pattern shown in FIG. 12B, but may be a random pattern even it is a constant pattern.

EXAMPLE 6

Next, a sixth example will be described with reference to FIGS. 13 to FIGS. 17A–17I FIG. 13 shows the brief structure of a color ink jet printer which can apply the present invention, and has nearly the same construction as the printer of Example 1 except for a plurality of printing heads and the corresponding structure.

The reference symbol 1*y* denotes a yellow ink printing head, 1*m* is a magenta ink printing head, and 1*c* denotes a cyan ink printing head. 1*k*1 and 1*k*2 are black ink printing heads, and is denotes a printing ability improving liquid printing head. 2 denotes a carriage equipped with printing heads. 3 denotes a flexible cable for sending electrical signals from the printer main unit to the printing head. 4 denotes a cap unit having recovery means. 5*y*, 5*m*, 5*c*, 5*k*2, 5*s*, and 5*k*1 denote cap members corresponding to the printing heads 1*y*, 1*m*, 1*c*, 1*k*2, 1*s*, and 1*k*1, and 6 (6S, 6*k*) denotes a wiper blade which is made of a member such as rubber: a wiper blade 6S corresponding to the printing head 1*s*, a wiper blade 6*k* corresponding to the printing heads 1*y*, 1*m*, 1*c*, 1*k*2, 1*k*1.

The printing heads 1*y*, 1*m*, 1*c*, 1*k*2, 1*s*, and 1*k*1 individually have 64 nozzles, and about 40 ng of ink or the printing ability improving liquid is ejected from each nozzle.

The following ink and printing ability improving liquid were used in the present example. The printing ability improving liquid was the same as used in Example 1.

| (Ink) | | |
|---|---|---|
| 1. Yellow | | |
| Triethyleneglycol | 7 | parts by weight |
| Hexanetriol | 7 | |
| Isopropyl alcohol | 2.5 | |
| Acetylenol | 0.02 | |
| C. I. Direct Yellow 86 | 1.5 | |
| Water | 81.98 | |
| 2. Magenta | | |
| Triethyleneglycol | 7 | parts by weight |
| Hexanetriol | 7 | |
| Isopropyl alcohol | 1.5 | |
| Acetylenol | 0.01 | |
| C. I. Acid Red 289 | 1.5 | |
| Water | 82.99 | |
| 3. Cyan | | |
| Triethyleneglycol | 7 | parts by weight |
| Hexanetriol | 7 | |
| Isopropyl alcohol | 1.5 | |
| Acetylenol | 0.01 | |
| C. I. Acid Red 289 | 2.5 | |
| Water | 81.99 | |
| 3. Black | | |
| Triethyleneglycol | 6 | parts by weight |
| Hexanetriol | 6 | |
| Butyl alcohol | 2 | |
| Lithium acetate | 0.01 | |
| C. I. Direct Black 154 | 2.5 | |
| Water | 82.9 | |

Figure 13:
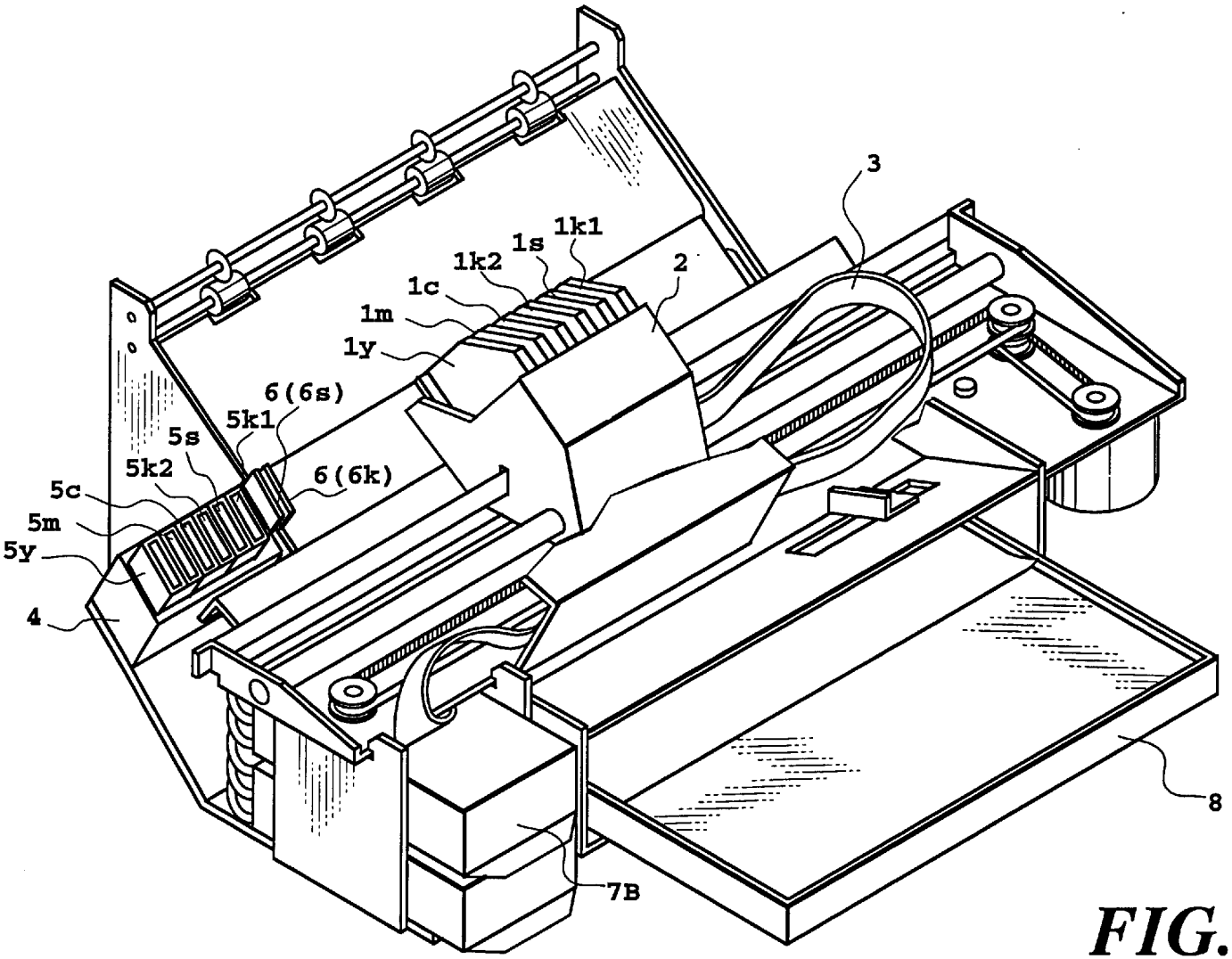
FIG. 13 is a schematic view showing a printer used in an embodiment 6.
Figure 14:
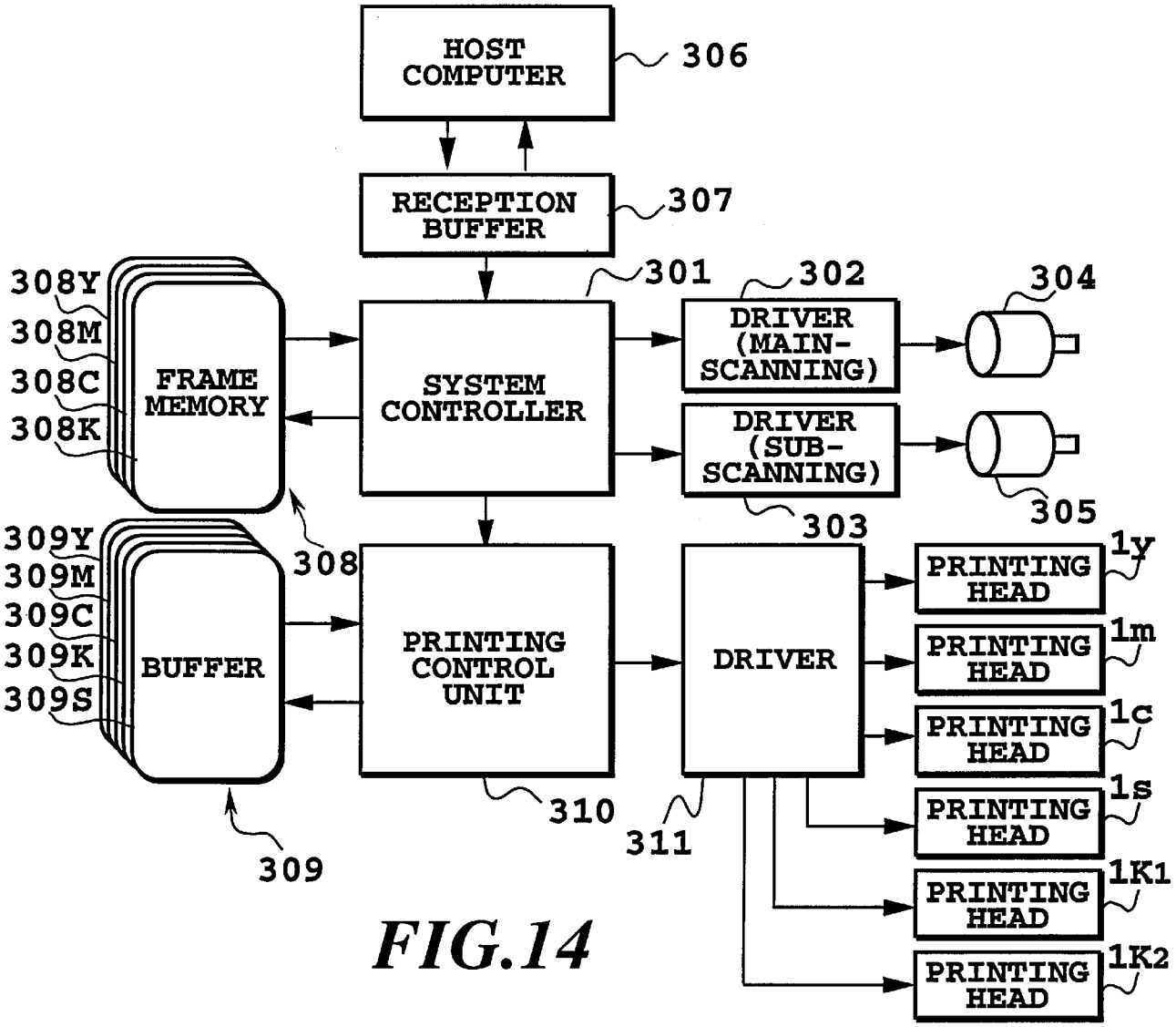
FIG. 14 is an electrical control block diagram of printer used in the embodiment 6.

FIG. 14 is an electrical control block diagram of the color ink jet printer shown in FIG. 13, and similar components to Example 1 have similar reference numerals. Since the electrical control in the present example is the same as in the above example, detailed description thereof is omitted.

Figure 15:
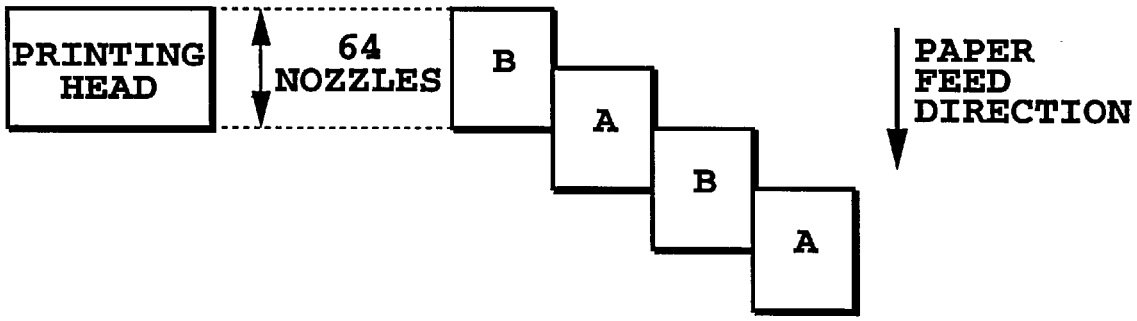
FIG. 15 is a schematic view for explaining a printing method in embodiment 6.

In the color ink jet printer of the present example, when printing a color image, image data of each color is divided into two parts according to the patterns shown in FIGS. 9A–9C, and each image is formed by two scannings of the printing head. FIG. 15 is a schematic view showing the process : the symbol A in the Figure represents scanning for printing according to the pattern shown in FIG. 9B, and symbol B represents scanning for printing according to the pattern shown in FIG. 9C. As can be seen from FIG. 15 , paper feed in an amount of 32 nozzles corresponding to a half of the number of nozzles of the printing head is made at every scanning of the printing head.

In the present example, picture elements having image data were all applied with the printing ability improving liquid. As the application method of the printing ability improving liquid, for the black image portion, after the black image is printed by the black ink printing head 1*k*1 as in Examples 1 to 5, the printing ability improving liquid is applied with the same data as the black image data, and then the black image is printed by the black ink printing head 1*k*2. For the color image portion, image data of yellow, magenta, and cyan are individually thinned to 50% according to the pattern shown in FIGS. 9B and 9C, and then logical sum of these yellow, magenta, and cyan thinned data is used as the data for ejecting the printing ability improving liquid, which is applied prior to the color image formation.

Figures 16A, 16B, 16C:
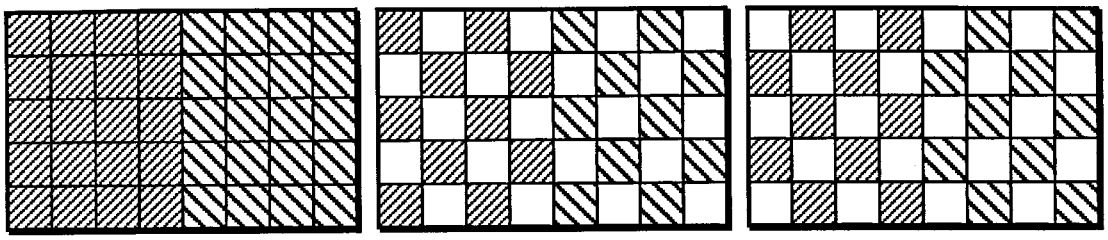
FIGS. 16A to 16E are schematic views for explaining application of the ink and the printing ability improving liquid in embodiment 6.
Figures 16D, 16E:
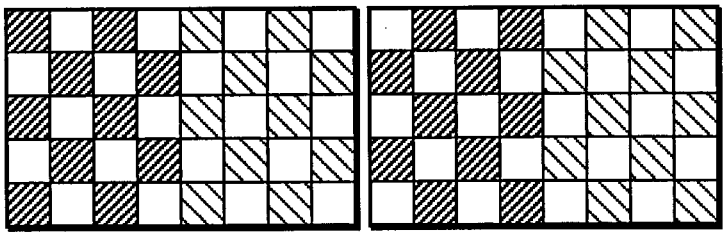

FIGS. 16A to 16E show schematic views showing application of the printing ability improving liquid to the black image and color image. FIG. 16A shows an example of the case where a black image and a yellow image as a color image are present. FIG. 16B shows an image obtained by dividing the image of FIG. 16A according to the pattern of FIG. 9B, and FIG. 16C shows an image divided according to the pattern of FIG. 9C. FIG. 16D shows the application pattern of the printing ability improving liquid to the divided image of FIG. 16B, and FIG. 16E shows the application pattern of the printing ability improving liquid to the divided image of FIG. 16C.

In the present example, in order to form the image by two scannings of the printing head, the range of detecting the print duty of black image is expanded two times from the window size described in FIG. 7 to 4 inches (1,440 columns). At this moment, the print duty changes the number of scannings for forming the image according to whether the print duty in one scanning of the printing image is less than 50% or exceeding 50%. A print duty of 50% in the expanded window is 64 nozzles×4 inches (1,440 columns)×½=40,080 picture elements.

In the present example, when the print duty is less than 50%, as shown in FIGS. 16A to 16E, the ink and printing ability improving liquid are applied by two scannings of the printing head. Application of the ink and printing ability improving liquid at this moment is made only in the forward scanning of the printing head, and printing paper feed is not made between the first and second scannings.

When the print duty exceeds 50%, application of the ink and printing ability improving liquid is made by four scannings of the printing head. The printing by four scannings is carried out according to the pattern shown in FIGS. 17A to 17I.

Figure 17A:
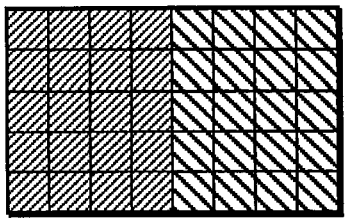
FIGS. 17A to 17I are schematic views for explaining application of the ink and the printing ability improving liquid in embodiment 6.
Figure 17B:
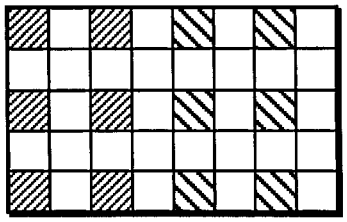
Figure 17C:
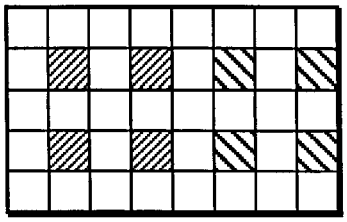
Figure 17D:
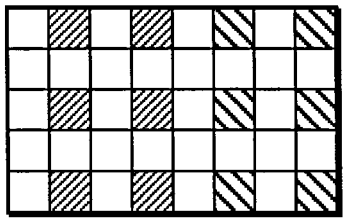
Figure 17E:
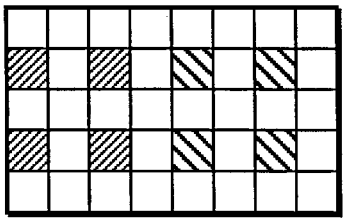
Figure 17F:
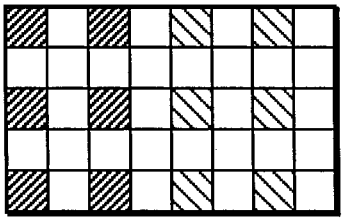
Figure 17G:
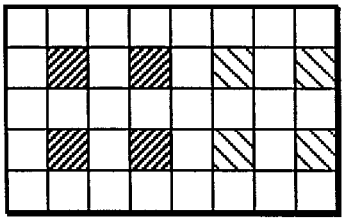
Figure 17H:
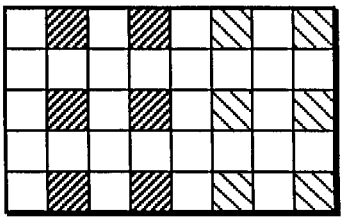
Figure 17I:
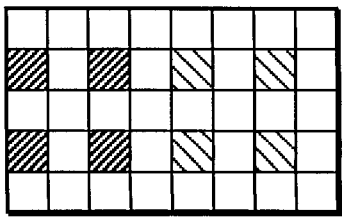

With respect to the image shown in FIG. 17A, FIGS. 17B, 17C, 17D, and 17E denote four divided images, and FIGS. 17F, 17G, 17H, and 17I denote application pattern of the printing ability improving liquid to the above divided images. In the first scanning data of the printing head, picture elements corresponding to the pattern shown in FIG. 17B are applied with the ink and the printing ability improving liquid. Next, the printing head returns to the home position side, and the picture elements corresponding to the pattern shown in FIG. 17C are applied with the ink and the printing ability improving liquid. Next, the printing head returns to the home position side, and the printing paper is fed by 32 nozzles. Then, the picture elements corresponding to the pattern shown in FIG. 17D are applied with the ink and printing ability improving liquid. Next, the printing head returns to the home position side, and the picture elements corresponding to the pattern shown in FIG. 17E are applied with the ink and printing ability improving liquid. Next, the printing head returns to the home position side, and the printing paper is fed by 32 nozzles. The above procedure is repeated to achieve image formation by four scannings of the printing head.

Also in the present example, generation of mist due to rebounding was suppressed and the reliability could be improved.

Further, the black image is high in density and a sharp image as in Example 1, and a color image can be obtained without bleeding of ink at the boundary between the black image and the color image. Further, water resistant images can be obtained for both the black image and color image.

EXAMPLE 7

Next, a seventh example will be described with reference to FIGS. 9A to 9C and FIGS. 18 to 22 (corresponding to the above described another embodiment).

Figure 21:
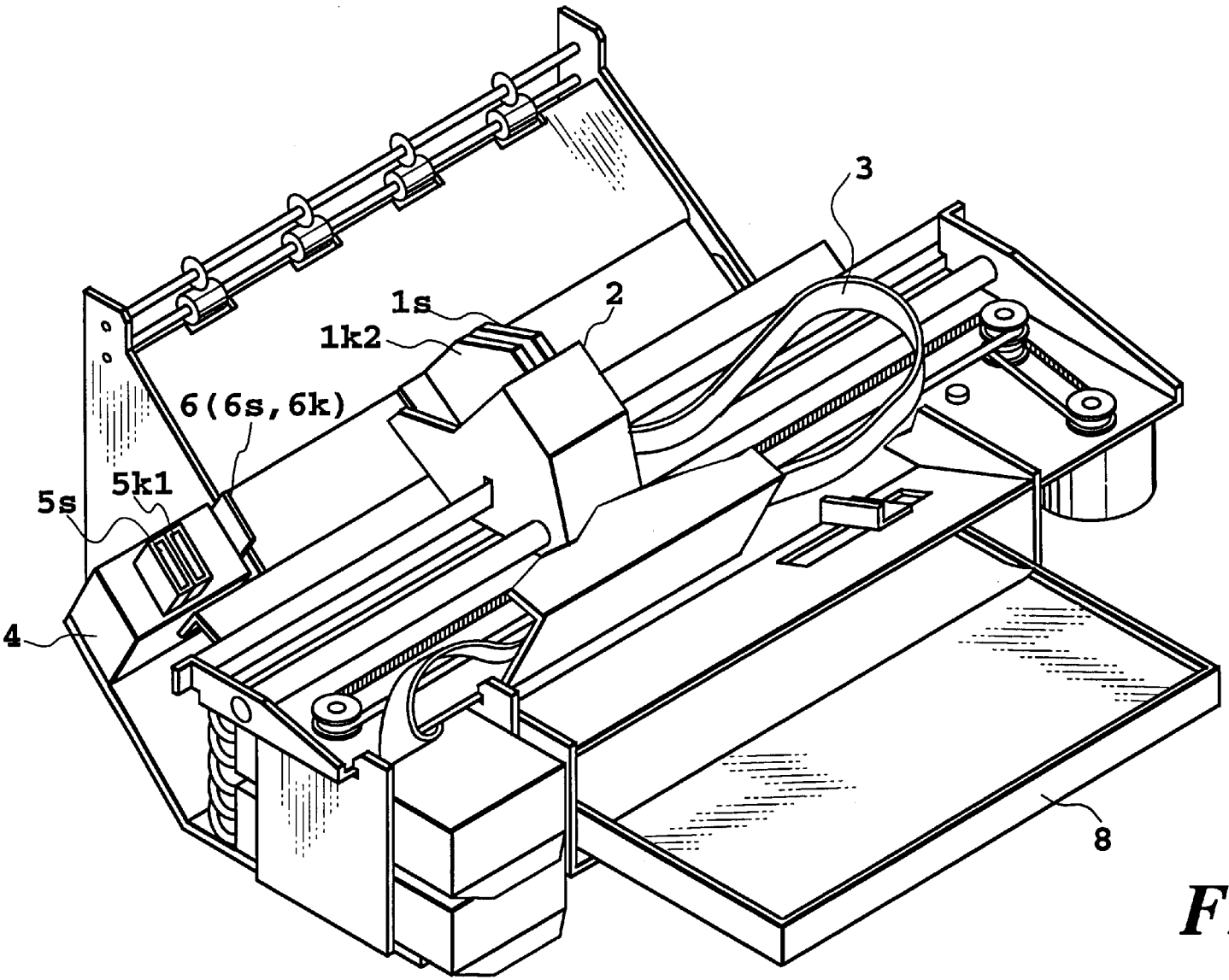
FIG. 21 is a schematic view showing a printer used in an embodiment 7.
Figure 22:
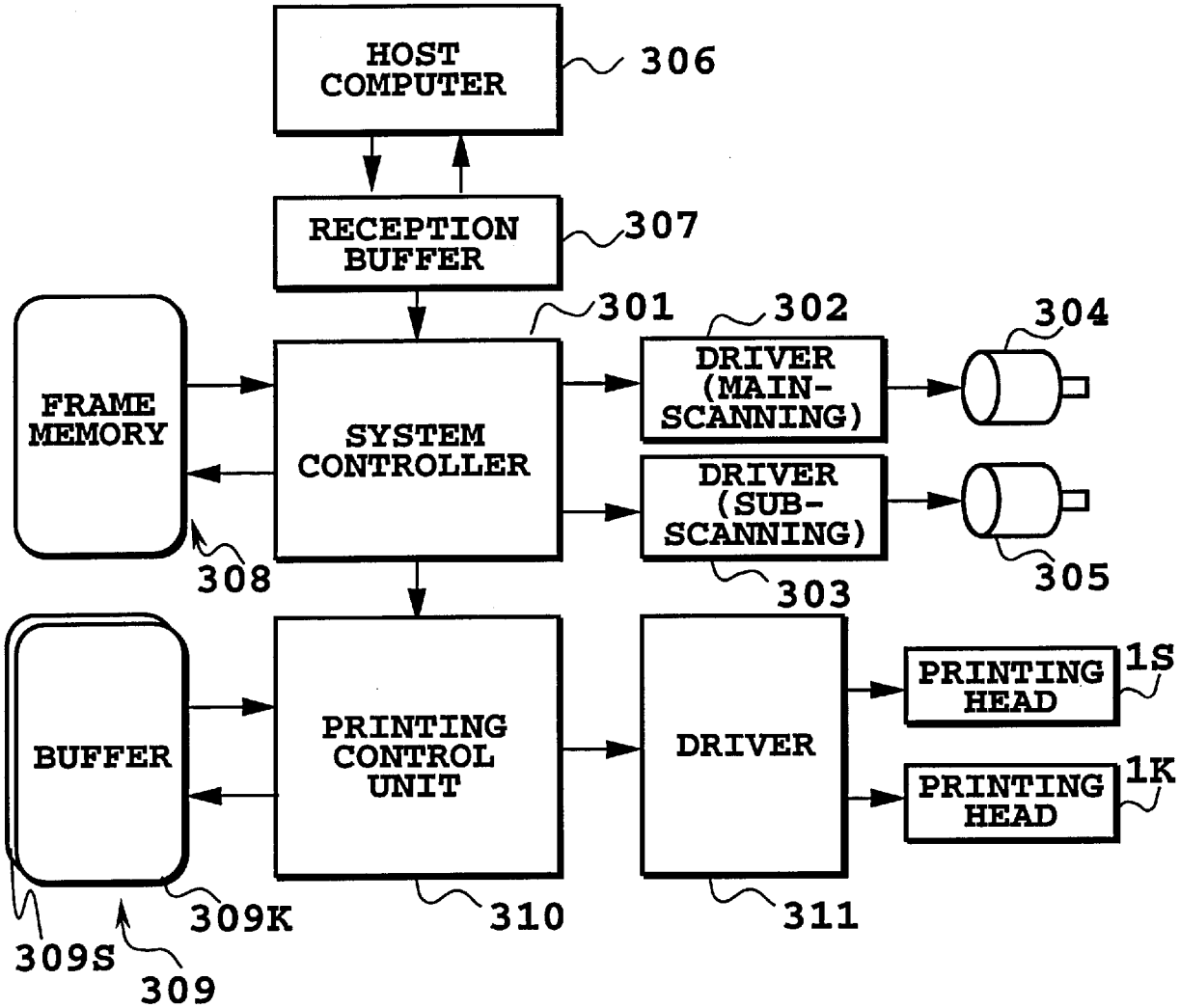
FIG. 22 is an electrical control block diagram of the printer used in embodiment 7.

In the present example, in the ink jet printing apparatus shown in FIG. 21 and FIG. 22, the printing method when the print duty exceeds 50% is differed from that of Example 1. However, the printing method when the print duty is less than 50% is the same as in Example 1.

FIGS. 9A to 9C show the printing method at that time, in which with respect to the image data of FIG. 9A, FIG. 9B shows the image (overall black picture elements) printed by the first scanning of the printing head, and FIG. 9C shows the image printed by the second scanning of the printing head. That is, when the print duty exceeds 50%, the image is formed by two scannings.

First in the first scanning of the printing head, to the image of FIG. 9A, only the picture elements of the pattern shown in FIG. 9B are printed. At this moment, printing dots s and k are sequentially applied by the printing heads is and 1k to the corresponding picture elements. Then, the printing head returns to the home position side, however, the printing paper is not fed. Further, only the picture elements of the pattern shown in FIG. 9C are printed by the next scanning of the printing head. Also at this moment, printing dots s and k are sequentially applied to the corresponding picture elements by the printing heads is and 1*k*. Finally, the printing head returns to the home position side and the printing paper is fed by an amount of 64 nozzles.

By the above described printing method, a black image was printed using the same ink and printing ability improving liquid as used in Example 1, and the same effect as Example 1 could be obtained.

OTHER EXAMPLE

In Example 1, as the printing method when the print duty exceeds 50%, application of the printing dot k2 by the printing head 1*k*2 is made in the forward scanning (printing is made from the home position side) of the printing head, however, alternatively, this may be made in the return scanning (printing is made from the opposite side of the home position) of the printing head.

At this moment, after application of the printing dots k1 and s is completed by the first scanning of the printing head, application of the printing dot k2 may be made in the process of returning the printing head to the home position side, and finally the printing paper may be fed by 64 nozzles. This method reduces the printing time as compared with Example 1.

Further, also in Example 2, as the printing method when the print duty exceeds 50%, the second scanning of the printing head is made in forward scanning, however, as described above, this may be made in return scanning. Also in this case, the printing time is reduced as compared with Example 2.

Further, in Example 2, when the print duty exceeds 50%, printing is made according to the pattern shown in FIGS. 9B and 9C, however, printing is not specifically limited to this pattern but may be a checkered pattern of every picture element as shown in FIGS. 4A and 4B.

Still further, in Examples 3 and 4, when the print duty is less than 33%, the image is formed by a single scanning of the printing head. However, to improve the reliability even further, printing may be always made by two scannings of the printing heads when the print duty is less than 66%, and printing may be made so that the number of scannings is increased when the duty exceeds 66%.

Yet further, in Examples 1 to 6, the window of the predetermined area is scanned, and the print duty in the window is detected, however, alternatively, the print duty in one scanning width of the printing image may be detected.

Ink usable for carrying out the present invention should not be limited only to dyestuff ink, and pigment ink having pigment dispersed therein can also be used. Any type of processing liquid can be used, provided that pigment is aggregated with it. The following pigment ink can be noted as an example of pigment ink adapted to cause aggregation by mixing with the treatment liquid A1 previously discussed. As mentioned below, yellow ink Y2, magenta ink M2, cyan ink C2 and black ink K2 each containing pigment and anionic compound can be obtained.

[Black ink K2]

The following materials are poured in a batch type vertical sand mill (manufactured by Aimex Co.), glass beads each having a diameter of 1 mm is filled as media using anion based high molecular weight material P-1 (aqueous solution containing a solid ingredient of styrene-methacrylic acid-ethylacrylate of 20% having an acid value of 400 and average molecular weight of 6000, neutralizing agent potassium hydroxide) as dispersing agent to conduct dispersion treatment for three hours while water-cooling the sand mill. After completion of dispersion, the resultant mixture has a viscosity of 9 cps and pH of 10.0. The dispersing liquid is poured in a centrifugal separator to remove coarse particles, and a carbon black dispersing element having a weight-average grain size of 10 nm is produced.

| Composition of carbon black dispersing element) | |
|---|---|
| P-1 aqueous solution (solid ingredient of 20%) | 40 parts |
| carbon black Mogul L (tradename: manufactured by Cablack Co.) | 24 parts |
| glycerin | 15 parts |
| ethylene glycol monobutyl ether | 0.5 parts |
| isopropyl alcohol | 3 parts |
| water | 135 parts |

Next, the thus obtained dispersing element is sufficiently dispersed in water, and black ink K2 containing pigment for ink jet printing is obtained. The final product has a solid ingredient of about 10%.

[Yellow ink Y2]

Anionic high molecular P-2 (aqueous solution containing a solid ingredient of 20% of stylen-acrlylic acid methyl methacrylate having an acid value of 280 and an average molecular weight of 11,000, neutralizing agent diethanolamine) is used as a dispersing agent and dispersive treatment is conducted in the same manner as production of the black ink K2 whereby yellow color dispersing element having a weight-average grain size of 103 nm is produced.

| (composition of yellow dispersing element) | |
|---|---|
| P-2 aqueous solution (having a solid ingredient of 20%) | 35 parts |
| C. I. pigment yellow 180 (tradename : Nobapalm yellow PH-G, manufactured by Hoechst Aktiengesellschaft) | 24 parts |
| triethylen glycol | 10 parts |
| diethylenglycol | 10 parts |
| ethylene glycol monobutylether | 1.0 parts |
| isopropyl alcohol | 0.5 parts |
| water | 135 parts |

The thus obtained yellow dispersing element is sufficiently dispersed in water to obtain yellow ink Y2 for ink jet printing and having pigment contained therein. The final product of ink contains a solid ingredient of about 10%.

[Cyan ink C2]

Cyan colored-dispersant element having a weight-average grain size of 120 nm is produced by using the anionic high molecular P-1 used when producing the black ink K2 as dispersing agent, and moreover, using the following materials by conducting dispersing treatment in the same manner as the carbon black dispersing element.

| (composition of cyan colored-dispersing element) | |
|---|---|
| P-1 aqueous solution (having solid ingredient of 20%) | 30 parts |
| C. I. pigment blue 153 (tradename : Fastogen blue FGF, manufactured by Dainippon Ink And Chemicals, Inc.) | 24 parts |
| glycerin | 15 parts |
| diethylenglycol monobutylether | 0.5 parts |
| isopropyl alcohol | 3 parts |
| water | 135 parts |

The thus obtained cyan colored dispersing element is sufficiently stirred to obtain cyan ink C2 for ink jet printing and having pigment contained therein. The final product of ink has a solid ingredient of about 9.6%.

[Magenta ink M2]

Magenta color dispersing element having a weight-average grain size of 115 nm is produced by using the anionic high molecular P-1 used when producing the black ink K2 as dispersing agent, and moreover, using the following materials in the same manner as that in the case of the carbon black dispersing agent.

| (composition of the magenta colored dispersing element) | |
|---|---|
| P-1 aqueous solution (having a solid ingredient of 20%) | 20 parts |
| C. I. pigment red 122 (manufactured by Dainippon Ink And Chemicals, Inc.) | 24 parts |
| glycerin | 15 parts |
| isopropyl alcohol | 3 parts |
| water | 135 parts |

Magenta ink M2 for ink jet printing and having pigment contained therein is obtained by sufficiently dispersing the magenta colored dispersing element in water. The final product of ink has a solid ingredient of about 9.2%.

In mixing of the processing liquid and the ink as set forth above, in the present invention, as a result of mixing of the processing liquid and the ink on the printing medium or at a position penetrating the printing medium in a certain magnitude, as the first stage of reaction, low molecule component or cation type oligomer in the cation type substance contained in the processing liquid, and anion type compound used in the water soluble dye or pigment ink having anion type group cause association by ionic interaction to separate from solution phase at a moment. As a result, dispersing break-down is caused in the pigment ink to form the coagulated body of the pigment.

Next, as the second stage of reaction, an association body of the above-mentioned dye and low molecule cation type substance or cation type oligomer or coagulated body of the pigment is absorbed by high molecule components included in the processing liquid. Therefore, the coagulated body of the dye or the coagulated body of the pigment caused by association becomes further greater in size to become difficult to penetrate into the gap between the fiber of the printing medium. As a result, only the liquid portion resulting from solid/liquid separation penetrates into the printing paper, both of printing quality and sensibility can be achieved. At the same time, viscosity of the coagulated body formed of the low molecule component of the cation substance or cation type oligomer, anion type dye and cation type substance, or the coagulated body of the pigment is increased to so as not to move according to movement of the liquid medium. Therefore, even when the adjacent ink dots are formed with different colors as in formation of a full color image, the color may not be mixed to each other. Therefore, bleeding is not caused. Also, since the coagulated body is essentially water insoluble, the moisture resistance of the formed image becomes complete. Also, color fastness to light of the formed image can be improved by the shielding effect of the polymer.

A word "insoluble" or "coagulate" used in this specification means a function in which a coloring agent, such as the dye and the pigment, is made insoluble or coagulate, and means a phenomenon only in the first stage, for one example, and phenomenon including both of the first and second stages, in another example.

On the other hand, in implementation of the present invention, since it is unnecessary to use cation high molecular substance having large molecule or polyvalent metal, or even when it is necessary to use such cation high molecular substance having large molecule or polyvalent metal salt, there are merely used auxiliary, the amount of use can be minimized. As a result, a problem of lowering of the color development of dye to be encountered when attempt is made to obtain the moisture resistant effect using the conventional cation type high molecular substance or polyvalent metal salt, can be avoided as another effect of the present invention.

It should be noted that the kind of the printing medium is not specified in implementation of the present invention, and conventionally used plain paper, such as copy paper, bond paper and so forth can be suitably used. Of course, a coated paper specially prepared for ink-jet printing, transparent film for OHP and so forth may also be used suitably. Also, general wood free paper, glossy paper and so forth may also used suitably.

As described above, with the embodiments according to the present invention, since printing is made using the printing head in which the nozzle for ejecting the printing ability improving liquid for insolubilizing or coagulating the coloring material in the ink is disposed between nozzles for ejecting the ink, a high-density and sharp image can be obtained.

Further, since the printing ability improving liquid can be ejected in both forward scanning and return scanning of the printing head, high speed operation of the printing apparatus is possible.

Still further, when the print duty in the predetermined scanning area of the printing head is high, the number of scannings of the printing head can be increased to reduce generation of mist due to rebounding of ink or printing ability improving liquid, thereby improving the reliability.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet printing method using an ink ejection portion having a nozzle for ejecting an ink and a printing ability improving liquid ejection portion having a nozzle for ejecting a printing ability improving liquid, and scanning said ejection portion in a main scanning direction with respect to a printing medium to form an image, said method comprising the steps of:

ejecting the ink from said ink ejection portion onto the printing medium; and ejecting the printing ability improving liquid from said printing ability improving liquid ejection portion onto the printing medium;

wherein, when a process for ejecting the ink and a process for ejecting the printing ability improving liquid are carried out based on image data to form the image on said printing medium while moving said ink ejection portion and said printing ability improving liquid ejection portion in the main scanning direction, a number of scannings of said ink ejection portion and said printing ability improving liquid ejection portion in the main scanning direction for making the process for ejecting the ink and the process for ejecting the printing ability improving liquid different according to a print duty of the image data to be recorded, and wherein when printing is performed with a print duty higher than the other print duty, a number of scannings of said ejection portion in the main scanning direction is greater than that for the other print duty.

2. The ink jet printing method as claimed in claim 1, wherein said image data is image data obtained by thinning original image data.

3. The ink jet printing method as claimed in claim 1, further comprising a first step for ejecting an ink having a first color as said ink from a first nozzle; and a second step for ejecting from a second nozzle a printing ability improving liquid differing from said ink;

wherein when said first step and said second step are carried out according to image data to form an image on said printing medium, the number of scannings in the main scanning direction for carrying out said first step and said second step is differed according to a print duty of said image data.

4. The ink jet printing method as claimed in claim 3, wherein when said print duty is high, the number of scannings of said ejection portion is increased to a greater value than when said print duty is low.

5. The ink jet printing method as claimed in claim 4, wherein when said print duty is low, said first step and said second step are carried out by one scanning; and when said print duty is high, said first step and said second step are carried out by separate scannings.

6. The ink jet printing method as claimed in claim 4, wherein when said print duty is low, said image data is divided into m parts to form the image by m scannings;

when said print duty is high, said image data is divided into n (n>m) parts to form the image by n scannings; and said first step and said second step are carried out in each of a single scanning.

7. The ink jet printing method as claimed in claim 3, wherein said first and second nozzles eject said ink or said printing ability improving liquid by heat energy generated by heat energy generation means.

8. The ink jet printing method as claimed in claim 1, wherein said printing ability improving liquid contains a compound for insolubilizing or coagulating a coloring material contained in said ink.

9. The ink jet printing method as claimed in claim 1, wherein data for ejecting said printing ability improving liquid is the same as said image data for said ink.

10. The ink jet printing method as claimed in claim 1, wherein data for ejecting said printing ability improving liquid is modified data obtained by thinning a predetermined pattern from said image data for said ink.

11. The ink jet printing method as claimed in claim 1, wherein a permeability of said printing ability improving liquid into said printing medium is higher than a permeability of said ink.

12. The ink jet printing method as claimed in claim 1, wherein said printing ability improving liquid contains a cationic substance comprising a low molecular weight component and a high molecular weight component, said ink contains a dyestuff, and said dyestuff comprises an anionic substance.

13. The ink jet printing method a s claimed in claim 1, wherein said printing ability improving liquid contains a cationic substance comprising a low molecular weight component and a high molecular weight component, and said ink contains an anionic dyestuff or at least an anionic compound and a pigment.

14. The ink jet printing method as claimed in claim 1, wherein said printing ability improving liquid contains a substance for insolubilizing or coagulating a coloring material contained in said ink.

15. An ink jet printing method using an ink ejection portion having a nozzle for ejecting an ink and a printing ability improving liquid ejection portion having a nozzle for ejecting a printing ability improving liquid, and scanning said ejection portion in a main scanning direction with respect to a printing medium to form an image, said method comprising the steps of:

ejecting the ink from said ink ejection portion onto the printing medium; and ejecting the printing ability improving liquid from said printing ability improving liquid portion onto the printing medium;

a first step for ejecting an ink having a first color as said ink from a first nozzle;

a second step for ejecting a printing ability improving liquid differing in printing ability from said ink from a second nozzle; and a third step for ejecting an ink having the same color as said ink having the first color from a third nozzle, wherein, when a process for ejecting the ink and a process for ejecting the printing ability improving liquid are carried out based on image data to form the image on said printing medium while moving said ink ejection portion and said printing ability improving liquid ejection portion in the main scanning direction, a number of scannings of said ink ejection portion and said printing ability improving liquid ejection portion in the main scanning direction for making the process for ejecting the ink and the process for ejecting the printing ability improving liquid different according to a print duty of the image data to be recorded, and wherein when printing is performed with a print duty higher than the other print duty, a number of scannings of said ejection portion in the main scanning direction is greater than that for the other print duty, and wherein when said first step to said third step are carried out according to image data to form an image on said printing medium, the number of scannings in the main scanning direction for carrying out said first step to said third step is different according to the print duty of said image data.

16. The ink jet printing method as claimed in claim 15, wherein when said print duty is high, the number of scannings is increased to a greater value than when said print duty is low.

17. The ink jet printing method as claimed in claim 16, wherein when said print duty is low, said first step to said third step are carried out by one scanning; and when said print duty is high, the scanning by said first step and said second step, and the scanning by said third step are carried out separately.

18. The ink jet printing method as claimed in claim 16, wherein when said print duty is low, said first step to said third step are carried out by one scanning; and when said print duty is high, the scanning by said first step, and the scanning by said second step and said third step are carried out separately.

19. The ink jet printing method as claimed in claim 16, wherein when said print duty is low, said first step to said third step are carried out by one scanning; and when said print duty is high, the scanning by said first step, the scanning by said second step, and the scanning by said third step are carried out separately.

20. The ink jet printing method as claimed in claim 16, wherein when said print duty is low, said image data is divided into m parts to form the image by m scannings;

when said print duty is high, said image data is divided into n (n>m) parts to form the image by n scannings; and said first step to said third step are carried out in each of a single scanning.

21. The ink jet printing method as claimed in claim 15, wherein said first to third nozzles eject said ink or said printing ability improving liquid by heat energy generated by heat energy generation means.

22. An ink jet printing apparatus using an ink ejection portion having a nozzle for ejecting an ink and a printing ability improving liquid ejection portion having a nozzle for ejecting a printing ability improving liquid, scanning said ejection portion in a main scanning direction with respect to a printing medium to form an image, said apparatus comprising:

first printing control means for controlling ejection of the ink from said ejection portion onto said printing medium;

second printing control means for controlling ejection of the printing ability improving liquid from said printing ability improving liquid ejection portion onto said printing medium; and scanning number control means whereby, when a control for ejecting the ink and a control for ejecting the printing ability improving liquid are carried out based on image data to form the image on said printing medium while a control for moving said ink ejection portion and said printing ability improving liquid ejection portion in the main scanning direction, a number of scannings of said ink ejection portion and said printing ability improving liquid ejection portion in the main scanning direction for making the control for ejecting the ink and the control for ejecting the printing ability improving liquid different according to a print duty of the image data to be recorded, wherein when printing is preferred with a print duty higher than the other print duty, a number of scannings of said ejection portion in the main scanning direction is greater than that for the other print duty.

23. The ink jet printing apparatus as claimed in claim 22, wherein said image data is image data obtained by thinning an original image data.

24. The ink jet printing apparatus as claimed in claim 22, wherein:

said first printing control means performs a first control for controlling ejection of an ink having a first color as said ink from a first nozzle;

said second printing control means performs a second control for controlling ejection of a printing ability improving liquid differing from said ink from a second nozzle; and said scanning number control means performs a third control for differing the number of scannings in the main scanning direction for carrying out said first control and said second control when said first control and second control are carried out according to image data to form an image on said printing medium.

25. The ink jet printing apparatus as claimed in claim 24, wherein when said print duty is high, the number of scannings is increased to a greater value than when said print duty is low.

26. The ink jet printing apparatus as claimed in claim 25, wherein when said print duty is low, control of said ejection portion by said first control and said second control is carried out by one scanning; and when said print duty is high, control of said ejection portion by said first control and control of said ejection portion by said second control are carried out by separate scannings.

27. The ink jet printing apparatus as claimed in claim 25, wherein when said print duty is low, said image data is divided into m parts (m=1, 2, . . . ) to form the image by m scannings;

when said print duty is high, said image data is divided into n (n>m) parts to form the image by n scannings; and said first control and said second control are carried out in each of a single scanning.

28. The ink jet printing apparatus as claimed in claim 24, wherein said first and second nozzles eject said ink or said printing ability improving liquid by heat energy generated by heat energy generation means.

29. The ink jet printing apparatus as claimed in claim 22, wherein said printing ability improving liquid contains a compound for insolubilizing or coagulating a coloring material contained in said ink.

30. The ink jet printing apparatus as claimed in claim 22, wherein data for ejecting said printing ability improving liquid is the same as said image data for said ink.

31. The ink jet printing apparatus as claimed in claim 22, wherein data for ejecting said printing ability improving liquid is a modified data obtained by thinning a predetermined pattern from said image data for said ink.

32. The ink jet printing apparatus as claimed in claim 22, wherein a permeability of said printing ability improving liquid into said printing medium is higher than a permeability of said ink.

33. The ink jet printing apparatus as claimed in claim 22, wherein said printing ability improving liquid contains a cationic substance comprising a low molecular weight component and a high molecular weight component, said ink contains a dyestuff, and said dyestuff comprises an anionic substance.

34. The ink jet printing apparatus as claimed in claim 22, wherein said printing ability improving liquid contains a cationic substance comprising a low molecular weight component and a high molecular weight component, and said ink contains an anionic dyestuff or at least an anionic compound and a pigment.

35. The ink jet printing apparatus as claimed in claim 22, wherein said ejection portion has a nozzle for color ink.

36. The ink jet printing apparatus as claimed in claim 21, wherein said printing ability improving liquid contains a substance for insolubilizing or coagulating a coloring material contained in said ink.

37. An ink jet printing apparatus using an ink ejection portion having a nozzle for ejecting an ink and a printing ability improving liquid ejection portion having a nozzle for ejecting a printing ability improving liquid, scanning said ejection portion in a main scanning direction with respect to a printing medium to form an image, said apparatus comprising:

first printing control means for controlling ejection of the ink from said ejection portion onto said printing medium;

second printing control means for controlling ejection of the printing ability improving liquid from said printing ability improving liquid ejection portion onto said printing medium; and scanning number control means whereby, when a control for ejecting the ink and a control for ejecting the printing ability improving liquid are carried out based on image data to form the image on said printing medium while a control for moving said ink ejection portion and said printing ability improving liquid ejection portion in the main scanning direction, a number of scannings of said ink ejection portion and said printing ability improving liquid ejection portion in the main scanning direction for making the control for ejecting the ink and the control for ejecting the printing ability improving liquid different according to a print duty of the image data to be recorded, and wherein when printing is preferred with a print duty higher than the other print duty, a number of scannings of said ejection portion in the main scanning direction is greater than that for the other print duty, and wherein said first printing control means performs a first control for controlling ejection of an ink having a first color as said ink from a first nozzle, said second printing control means performs a second control for controlling ejection of a printing ability improving liquid differing in printing ability from said ink from a second nozzle, said first printing control means performs a third control for controlling ejection of an ink having the same color as said ink having the first color from a third nozzle, and said scanning number control means performs a fourth control for differing the number of scannings in the main scanning direction for carrying out said first control to said third control when said first control to said third control are carried out according to image data to form an image on said printing medium.

38. The ink jet printing apparatus as claimed in claim 37, wherein when said print duty is high, the number of scannings is increased to a greater value than when said print duty is low.

39. The ink jet printing apparatus as claimed in claim 38, wherein when said print duty is low, control of said ejection portion by said first control to said third control is carried out by one scanning; and when said print duty is high, control of said ejection portion by said first control and said second control, and control of said ejection portion by said third control are carried out by separate scannings.

40. The ink jet printing apparatus as claimed in claim 38, wherein when said print duty is low, control of said ejection portion by said first control to said third control is carried out by one scanning; and when said print duty is high, control of said ejection portion by said first control, and control of said ejection portion by said second control and said third control are carried out by separate scannings.

41. The ink jet printing apparatus as claimed in claim 38, wherein when said print duty is low, control of said ejection portion by said first control to said third control is carried out by one scanning; and when said print duty is high, control of said ejection portion by said first control, control of said ejection portion by said second control, and control of said ejection portion by said third control are carried out separately.

42. The ink jet printing apparatus as claimed in claim 38, wherein when said print duty is low, said image data is divided into m parts (m=1, 2, . . . ) to form the image by m scannings;

when said print duty is high, said image data is divided into n (n>m) parts to form the image by n scannings; and said first control to said third control are carried out in each of a single scanning.

43. The ink jet printing apparatus as claimed in claim 37, wherein said first to third nozzles eject said ink or said printing ability improving liquid by heat energy generated by heat energy generation means.

* * * * *

UNITED STATES PATENT AND TRADEMARK OFFICE

CERTIFICATE OF CORRECTION

PATENT NO. : 6,137,507
DATED : October 24, 2000
INVENTOR(S) : Toshiharu Inui, et al.

It is certified that error appears in the above-identified patent and that said Letters Patent is hereby corrected as shown below:

Column 2,
Line 16, "is" (both occurrences) should read -- be --.

Column 3,
Line 13, "is resulted" should read -- results --.

Column 5,
Line 6, "printer" should read -- the printer --;
Line 7, "the" should be deleted;
Line 37, "include" should read -- includes --; and
Line 51, "is" should read -- 1s --.

Column 7,
Line 52, "is," should read -- 1s, --; and
Line 63, "FIG." should read -- FIGS. --.

Column 8,
Line 4, "is" should read -- 1s --.

Column 10,
Line 20, "is" should read -- 1s --;
Line 25, "material" should read -- material 7 --; and
Line 30, "is," should read -- 1s, --.

Column 11,
Line 56, "is" should read -- 1s --; and
Line 62, "Is." should read -- 1s --.

Column 14,
Line 13, "difference" should read -- different --;
Line 42, "even" should read -- even if --; and
Line 54, "is" should read -- 1s --.

Column 17,
Line 16, "is" should read -- 1s --; and
Line 23, "is" should read -- 1s --.

UNITED STATES PATENT AND TRADEMARK OFFICE

CERTIFICATE OF CORRECTION

PATENT NO. : 6,137,507
DATED : October 24, 2000
INVENTOR(S) : Toshiharu Inui, et al.

It is certified that error appears in the above-identified patent and that said Letters Patent is hereby corrected as shown below:

Column 18,
Line 15, "is" should read -- are --;
Line 19, "agent" should read -- agent : --;
Line 47, "agent" should read -- agent : --;
Line 60, "triethylen" should read -- triethylene --; and
Line 61, "diethylenglycol" should read -- diethylene glycol --.

Column 20,
Line 4, "of" should be deleted; and
Line 9, "to" (first occurrence) should be deleted.

Column 21,
Line 13, medium:" should read -- medium, --; and
Line 24, "different" should read -- is different --.

Column 22,
Line 20, "a s" should read -- as --;
Line 38, "and" should be deleted;
Line 52, "image" (first occurrence) should read -- an image --; and
Line 60, "different" should read -- is different --.

Column 23,
Line 65, "different" should read -- is different --.

Column 25,
Line 8, "claim 21," should read -- claim 22, --.
Line 36, "different" should read -- is different --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*